US007158026B2

(12) United States Patent
Feldkamp et al.

(10) Patent No.: US 7,158,026 B2
(45) Date of Patent: Jan. 2, 2007

(54) SECURITY SYSTEM CONFIGURED TO PROVIDE VIDEO AND/OR AUDIO INFORMATION TO PUBLIC OR PRIVATE SAFETY PERSONNEL AT A CALL CENTER OR OTHER FIXED OR MOBILE EMERGENCY ASSISTANCE UNIT

(75) Inventors: Gregory E. Feldkamp, Southlake, TX (US); Mark A. Kolb, Austin, TX (US); Harris Bass, Austin, TX (US); Mary Hogue, Orlando, FL (US); Ann Benolken, Austin, TX (US)

(73) Assignee: @Security Broadband Corp., Austin, TX (US)

( * ) Notice: Subject to any disclaimer, the term of this patent is extended or adjusted under 35 U.S.C. 154(b) by 132 days.

(21) Appl. No.: 10/774,203

(22) Filed: Feb. 6, 2004

(65) Prior Publication Data

US 2005/0174229 A1 Aug. 11, 2005

(51) Int. Cl.
*G08B 1/00* (2006.01)

(52) U.S. Cl. ..... 340/531; 340/506; 340/539.25; 340/825.36; 340/825.49

(58) Field of Classification Search ..... 340/531, 340/506, 539.25, 825.36, 825.49
See application file for complete search history.

(56) References Cited

U.S. PATENT DOCUMENTS

| | | | | |
|---|---|---|---|---|
| 5,546,072 | A * | 8/1996 | Creuseremee et al. | 340/574 |
| 5,801,618 | A * | 9/1998 | Jenkins | 340/426.14 |
| 5,844,599 | A * | 12/1998 | Hildin | 348/14.1 |
| 6,243,683 | B1 * | 6/2001 | Peters | 704/273 |
| 6,400,265 | B1 * | 6/2002 | Saylor et al. | 340/531 |
| 6,587,046 | B1 * | 7/2003 | Joao | 340/539.14 |
| 6,965,294 | B1 * | 11/2005 | Elliott et al. | 340/5.2 |
| 6,975,220 | B1 * | 12/2005 | Foodman et al. | 340/531 |

* cited by examiner

*Primary Examiner*—Daryl C Pope
(74) *Attorney, Agent, or Firm*—Conley Rose, P.C.

(57) ABSTRACT

A security system for monitoring a premises. Alarm information, including a near real-time feed of video and/or audio data, is collected at the premises and retrieved by a remotely located monitoring computer workstation over a data network. If desired, a remotely located emergency response computer workstation coupled to the data network may be authorized, by the monitoring computer workstation, to retrieve the collected alarm information over the data network. The emergency response computer workstation may also be granted control of the alarm information collecting devices located at the monitored premises.

129 Claims, 5 Drawing Sheets

SECURITY SYSTEM CONFIGURED TO PROVIDE VIDEO AND/OR AUDIO INFORMATION TO PUBLIC OR PRIVATE SAFETY PERSONNEL AT A CALL CENTER OR OTHER FIXED OR MOBILE EMERGENCY ASSISTANCE UNIT

CROSS-REFERENCE TO RELATED APPLICATIONS

Not Applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The invention is directed to security systems and, more particularly, to a security system configured to provide video and/or audio information related to an alarm condition to public or private safety personnel at a call center or other fixed or mobile emergency assistance unit.

BACKGROUND OF THE INVENTION

The popularity of monitored security systems has increased dramatically in recent years. Such systems typically include contact sensors installed at doors, windows and other potential entry points to a home, business establishment or other type of premises to be monitored and any number of motion sensors installed at selected locations inside the premises. More elaborate security systems may include any number of other types of sensors, for example, glass breakage detectors, panic or medical alert buttons, smoke detectors and temperature sensors.

When a security system is armed and a sensor is tripped, a sensor activation signal is transmitted to a main controller. In turn, the main controller issues an alarm signal to a central monitoring station, for example, via the public switched telephone network ("PSTN") or a wireless network. Upon receipt of the alarm signal, an operator at the central monitoring station will evaluate the received alarm signal and determine whether to notify police, fire, emergency medical personnel, or other public or private safety personnel, typically, via a telephone call over the PSTN. Many monitored security system providers instruct the operator at the central monitoring station to attempt to contact the owner or resident of the building to determine if the received alarm signal is a false alarm and to contact the police or other appropriate public or private safety personnel if the operator is unable to contact the owner or resident of the building or unable to conclude, based upon their contact with the owner or resident, whether the received alarm signal is a false alarm.

More sophisticated monitored security systems have enhanced the ability of the operator at the central monitoring station to evaluate an alarm signal received from a monitored site. For example, U.S. 2002/0147982 A1 to Naidoo et al. is directed to a video security system in which alarm information and video relating to an alarm condition is transmitted to an operator at a central monitoring station in substantially real-time. Using the received alarm information and substantially real-time video, the operator verifies whether the alarm signal corresponds to an actual alarm condition and, if so, notifies the appropriate public or private safety personnel of the alarm condition at the home or other building. Such monitored security systems provide operators with additional information which enables the operator to better assess a detected alarm condition. As a result, the operator is able to classify many detected alarm conditions as false alarms, thereby eliminating any need for the operator to contact the appropriate public or private safety personnel. However, while the operator has additional information regarding a detected alarm condition, this information can only be relayed to the public or private safety personnel through an extended verbal exchange. As a result, in many emergency situations, information that would be useful in fashioning an appropriate response to a detected alarm condition is unavailable to the public or private safety personnel charged with the task of responding to the emergency situation.

It should be readily appreciated that the information used by the operator to assess a detected alarm condition would likely be even more useful by public or private safety personnel in fashioning an appropriate response to the alarm condition. It is, therefore, the object of this invention to provide a method and associated system by which alarm information used by monitoring personnel to assess a detected alarm condition may be forwarded to the public or private safety personnel charged with responding to the alarm condition.

SUMMARY OF THE INVENTION

In one embodiment, the present invention is directed to a security system for monitoring a premises which includes at least one device for collecting alarm information at the monitored premises, one or more monitoring computer workstations remotely located relative to the monitored premises and one or more emergency response computer workstations remotely located relative to the monitored premises. The collected alarm information, which preferably includes a near real-time stream of either video data, audio data or both video and audio data, is transported to a first monitoring computer workstation over a data network. In turn, the first monitoring computer workstation authorizes transport of the collected alarm information to a first emergency response computer workstation, again over the data network. Variously, the first emergency response computer workstation may be located at a public safety call center, an emergency response vehicle or a facility operated by private security personnel.

In further aspects of this embodiment of the invention, operation of the alarm information collecting devices may be remotely controlled over the data network. Variously, the monitoring computer workstation may be configured to: (1) control the operation of the alarm information collecting devices; and/or (2) cede control of the operation of the at least one alarm information collecting device to the emergency response computer workstation, thereby enabling the emergency response computer workstation to control the operation of the alarm information collecting devices. In still further aspects of the invention, a computer server remotely located relative to the monitored premises and coupled to the data network receives the alarm information collected by the at least one alarm information collection device. In this aspect, the monitoring computer workstation may share the alarm information by authorizing the emergency response computer workstation to access the alarm information received by the computer server.

In still further aspects of this embodiment of the invention, the security system may further include a manager workstation configured to suspend authorization of the transport of the collected alarm information to the first emergency response computer workstation and/or suspend authorization of the first emergency response computer workstation to control delivery of the collected alarm information. The manager workstation may be further configured to cancel suspension of the authorization of the transport of the collected alarm information to the first emergency response computer workstation. Variously, the manager workstation may be collocated with the first monitoring computer workstation or the first emergency response computer workstation. In still yet further aspects thereof, the security system may also include an application administration workstation configured to control eligibility of the first emergency response computer workstation to be authorized to control the operation of the alarm information collecting devices and to be authorized to control the delivery of the collected alarm information. Variously, the application administration workstation is configured to manage eligibility on either a discriminatory basis or on a non-discriminatory basis.

In another embodiment, the present invention is directed to a security system for monitoring a premises which includes at least one device for collecting alarm information at the monitored premises, a first computer server, a first computer workstation remotely located relative to the monitored premises and a second computer workstation remotely located relative to the monitored premises. The first computer server receives the alarm information from the at least one alarm information collecting device over a first data path. In turn, the first computer workstation receives the alarm information from the first computer server over a second data path. If the first computer workstation authorizes the second computer workstation to receive the alarm information from the first computer server, the second computer workstation will receive the alarm information, which preferably includes a near real-time stream of either video data, audio data, or both video and audio data from the first computer server, over a third data path. Variously, it is contemplated that the first, second and third data paths may are secured data paths, non-secured data paths or a combination of secured or non-secured data paths.

In various aspects thereof, the collection of alarm information is controlled by the first computer workstation using control commands transmitted to the first computer server over the second, secured or non-secured, data path and passed, by the first computer server, to the at least one alarm information collecting device over the first, secured or non-secured, data path. In still other aspects thereof, the security system further includes a second computer server which receives, over a fourth data path, requests, from the first computer workstation, for authorization of the second computer workstation to receive the alarm information from the first computer server. In still further aspects thereof, the second computer workstation receives, over a fifth data path, information, from the second computer server, enabling the second computer workstation to access the alarm information received by the first computer server. As before, it is variously contemplated that the fourth and fifth data paths are secured data paths, non-secured data paths or a combination of secured and non-secured data paths.

In still further aspects thereof, the collection of alarm information by the at least one device is controlled by the second computer workstation using control commands transmitted to the first computer server over the third, secured or non-secured, data path and passed, by the first computer server, to the at least one device over the first, secured or non-secured, data path if the second computer server receives, over the fourth, secured or non-secured, data path, a message, from the first computer workstation, indicating that the first computer workstation has ceded control of the collection of alarm information to the second computer workstation and the second computer workstation has received, over the fifth, secured or non-secured, data path, information, from the second computer server, enabling the second computer workstation to assume the control of the at least one alarm information collecting device.

In still yet further aspects thereof, the security system further includes a third computer workstation. In this aspect, the second computer server receives, over a sixth data path, requests, from the third computer workstation, to disable the authorization of the second computer workstation to receive the alarm information from the first computer server. In a related aspect, the second computer workstation receives, over the fifth secured or non-secured data path, information, from the second computer server, disabling the second computer workstation's ability to access the alarm information received by the first computer server. Variously, it is contemplated that the sixth data path may either be a secured data path or a non-secured data path.

In still another embodiment, the present invention is directed to a security system for monitoring a premises which includes at least one device for collecting alarm information at the monitored premises, a first computer server, a monitoring computer workstation remotely located relative to the monitored premises and an emergency response computer workstation remotely located relative to the monitored premises. The first computer server receives the alarm information from the at least one alarm information collecting device over a first data path. In turn, the monitoring computer workstation receives the alarm information from the first computer server. If the monitoring computer workstation authorizes the emergency response computer workstation to receive the alarm information from the first computer server, the emergency response computer workstation will receive the alarm information, which preferably includes a near real-time stream of either video data, audio data, or both video and audio data from the first computer server.

In various aspects thereof, the monitoring computer workstation and the emergency response computer workstation are respectively configured to transport audio information to the first computer server. In turn, the first computer server is further configured to transport audio information originating at either the monitoring computer workstation or the emergency response computer workstation to an audio station forming part of the at least one alarm information collecting device located at the monitored premises. In others, the monitoring computer workstation is further configured to control the collection of alarm information by the at least one device using control commands transmitted, by the monitoring computer workstation, to the first computer server for relaying to the at least one device. In still others, the security system further includes a second computer server for receiving requests, from the monitoring computer workstation, for authorization of the emergency response computer workstation to receive the alarm information from the first computer server.

In still yet further aspects thereof, the security system further includes a manager workstation configured to suspend authorization of the transport of the collected alarm information to the second computer workstation and/or suspend authorization of the second computer workstation to control delivery of the collected alarm information. The manager workstation may be further configured to cancel suspension of the authorization of the transport of the collected alarm information to the second computer workstation. Variously, the manager workstation may be collocated with the first computer workstation or the second computer workstation. In still yet further aspects thereof, the security system may also include an application administration workstation configured to control eligibility of the second computer workstation to be authorized to control the operation of the alarm information collecting devices and to be authorized to control the delivery of the collected alarm information. Variously, the application administration workstation is configured to manage eligibility on either a discriminatory basis or on a non-discriminatory basis.

In still yet another embodiment, the present invention is directed to a security system of monitoring a premises which includes means for collecting alarm information at the monitored premises, a monitoring computer workstation remotely located relative to the monitored premises and configured to retrieve the collected alarm information over a data network, an emergency response station coupled to the data network and remotely located relative to the monitored premises, and means for authorizing the emergency response computer workstation to retrieve the collected alarm information over the data network.

In one aspect thereof, the means for collecting alarm information at the monitored premises includes a base station coupled to the data network and located at the monitored premises and at least one video camera coupled to the base station. In this aspect, the alarm information is comprised of a near real-time stream of video data from a first one of the at least one video camera. In another aspect thereof, the security system further includes means for controlling the plurality of video cameras from the monitoring computer workstation and means for ceding control of the plurality of video cameras from the monitoring computer workstation to the emergency response computer workstation.

In another embodiment, the present invention is directed to a security system for monitoring a premises which includes at least one device for collecting alarm information at the monitored premises, a computer server, a monitoring computer workstation remotely located relative to the monitored premises and an emergency response computer workstation remotely located relative to the monitored premises. The computer server receives the alarm information from the at least one alarm information collecting device for subsequent delivery, of the received alarm information to the monitoring computer workstation. If the computer server receives, from the monitoring computer workstation, a request for authorization of the emergency response computer workstation to receive the alarm information, the emergency response computer workstation will subsequently receive the alarm information from the computer server.

In various ones of the foregoing embodiments of the invention, the alarm information collecting devices may include video cameras, audio stations or both. The alarm information collected by these devices may be variously comprised of a near real-time stream of video data, a near real-time stream of audio data, a near real-time stream of video and audio data, recorded video data, recorded audio data or recorded video and audio data. The computer workstations remotely located relative to the alarm information collecting devices may control the alarm information collecting devices in various manners such as causing video data acquisition to switch between video cameras, causing the video camera to pan, tilt, zoom, focus, adjust aperture or adjust white balance, causing audio data acquisition to switch between audio stations, selecting between one-way and two-way audio transmissions, adjusting microphone sensitivity of the audio station, or adjusting speaker volume of the audio station.

DETAILED DESCRIPTION OF THE INVENTION

Figure 1:
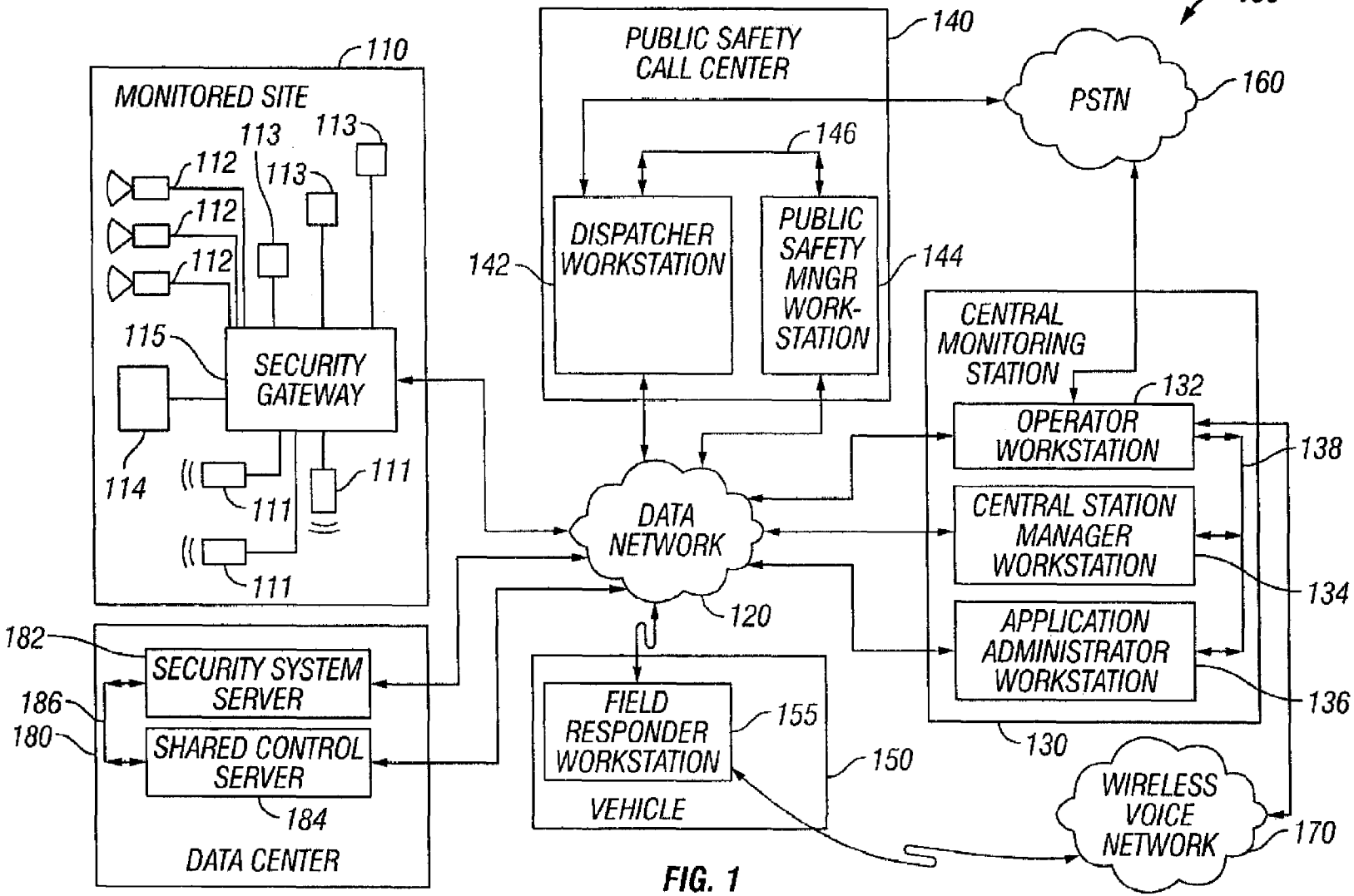
FIG. 1 is a block diagram of a security system constructed in accordance with the teachings of the present invention and configured to provide video and/or audio information related to an alarm condition occurring at a monitored premises to a public or private safety call center or other fixed or mobile emergency assistance unit.

Referring now to FIG. 1, a security system 100 constructed in accordance with the teachings of the present invention and configured to provide video and/or audio information related to an alarm condition occurring at a monitored premises to a safety call center will now be described in greater detail. As used herein, the term "security system" refers to a system for monitoring a premises, e.g., for the purpose of discouraging and responding to burglaries, fires, and other emergency situations. Such a security system is well suited for use in conjunction with a variety of applications, including residential homes, schools, nursing homes, hospitals, businesses and/or any other type of physical premises or geographic locale for which the detection of alarm conditions and/or the acquisition of video, audio and/or other types of information would be desirable. Further, as disclosed herein, the safety call center to which video and/or audio information related to an alarm condition occurring at a monitored premises is provided is a public safety call center. It should be clearly understood that it is fully contemplated that the video and/or audio information may instead be provided to a private safety call center or other public or private facility charged with providing the services disclosed herein.

As may now be seen, the security system 100 includes plural sites 110, 130, 140, 150 and 180 coupled together by a data network 120, for example, the Internet. Broadly speaking, each of these sites is either a "serving" site which provides security services to other sites within the security system 100 or a "served" site which receives security services from one or more "serving" sites of the security system 100. As disclosed herein, the site 110 is a served site while the sites 130, 140, 150 and 180 are serving sites. As further disclosed herein, the plural sites 110, 130, 140, 150 and 180, respectively, are a monitored site 110, a central monitoring station 130, a public safety call center 140, an emergency response vehicle 150 and a data center 180. It should be clearly understood, however, that other types of sites may serve in place of those disclosed herein. For example, as previously set forth, a private safety call center may serve in place of the disclosed public safety call center 150. Further by way of example, the emergency response vehicle 150 may be any one of a wide variety of types of motorized conveyances, for example, cars, ambulances or fire engines or non-motorized conveyances, for example, bicycles. Finally, it is further contemplated that the emergency response vehicle 150 shall also encompass field responders without benefit of a conveyance, for example, patrolmen walking a beat or security guards manning a post.

As still further disclosed herein, each one of the served site 110 and the plural serving sites 130, 140, 150 and 180 are remotely located relative to the other served and/or serving sites. Of course, it is fully contemplated, however, that one or more of the served and/or serving sites 110, 130, 140, 150 and 180 may be collocated with one or more of the other served and/or serving sites. It should be noted, however, that the configuration of the security system 100 illustrated in FIG. 1 is purely by way of example and that it is fully contemplated that other configurations of the security system 100 are suitable as well. In one such alternate configuration, the security system 100 may further include a remotely located station (not shown) from which the owner or another person responsible for the monitored site 110 could review alarm conditions at the monitored site 110. For example, the data center 180 could maintain information regarding the location of the remotely located station and, in the event that the data center 180 subsequently decides to issue alarm information and/or a near real-time alarm video and/or audio to the central monitoring station 130, the data center 180 may also issue the same data to the remotely located station as well. If desired, this remotely located station may be further equipped to perform many of the same control functions which, as will be more fully described below, the central monitoring station 130 is equipped to perform. Finally, the remotely located station may also be equipped to perform lifestyle monitoring of the site 110, for example, by initiating the acquisition of video images from a selected one of the video cameras 112.

As disclosed herein, the data network 120 is the Internet. It is fully contemplated, however, that the data network 120 may instead be a private network, for example, a private wide area network ("WAN") or a public network other than the Internet. It is further contemplated that the data network may be comprised of a single network, either public or private, or a combination of plural networks, either all public, all private or a combination of public and private networks. In many cases, however, it is preferred that the Internet is used for all or part of the data network 120, thereby avoiding the need for installing, purchasing, or leasing large amounts of infrastructure. It is still further contemplated that the data network may be entirely comprised of a wired network, a wireless network, or a combination of wired and wireless networks. For some security systems, particularly those that have frequent need of high-bandwidth transmissions, it may be desirable to include dedicated high-bandwidth connections including, without limitation, leased lines, frame relay networks, and asynchronous transfer mode ("ATM") networks, within the data network 120. Finally, given the near real-time nature of the information that is transmitted, it may be desirable that the data network 120 be a network that guarantees a certain quality of service ("QoS").

While the Internet is the preferred choice for the data network 120, secure virtual private network ("VPN") tunnels or other secure tunneling arrangements are to be used to carry traffic between software modules residing at non-collocated, non-mobile workstations, for example, operator workstation 132 or dispatcher workstation 142 or non-collocated, mobile workstations, for example, field responder workstation 155. Thus, while the various elements of the security system 100 are coupled together by the data network 120, in fact, a set or collection of secured data paths are used to transport data between the various served and serving sites 110, 130, 140, 150 and 180 of the security system 100. Of course, while it is preferred that a set or collection of secured data paths are used to transport data between the various served and serving sites 110, 130, 140, 150 and 180 of the security system 100, it should be noted that, while less desirable, a set or collection non-secured data paths may instead be used to transport data between the various served and serving sites 130, 140, 150 and 180 of the security system. It is also contemplated that a combination of selected secured and non-secured data paths may be used. For example, secured data paths may be used for the more sensitive connections, most commonly, the connection between the monitored site 110 and the data center 180 and the connection between the data center 180 and the central monitoring station 130, while non-secured paths may be used for the less sensitive connections, most commonly, the connection between the public safety call center 140 and the emergency response vehicle 150. Transport between software components in mobile workstations, for example, the field responder workstation 155, and non-mobile systems within the data center 180 relies, in part, on wireless WAN and/or wireless local area network ("LAN") connectivity. Preferably, the wireless connectivity supports sustained data rates of at least 100 Kbps in order to ensure that the field responder workstation 155 can receive a video and/or audio feed.

As previously set forth, the serving site 130 is a central monitoring station, the serving site 140 is a public safety call center, the serving site 150 is an emergency response vehicle which is dispatched by the public safety call center 140 in response to calls for assistance, and the serving site 180 is a data center. While the function of each of these sites will be more fully described later, it should be noted that the serving sites 130, 140, 150 and 180 may be subdivided into two types of serving sites—discriminatory serving sites and non-discriminatory serving sites. A non-discriminatory serving site provides security services to all members of a class. For example, the police force for a city would respond to emergency situations occurring at any address within the city limits. Thus, the public safety call center 140 and the emergency response vehicle 150 are non-discriminatory serving sites. As will be more fully described below, in one embodiment, the security system 100 may be configured such that a facility operated by private safety personnel and/or a privately operated emergency response vehicle may be substituted in place of the public safety call center 140 and/or the emergency response vehicle 150, respectively. While private safety personnel are typically charged with security services for a selected area, for example, a subdivision, a facility operated by private safety personnel, as well as a privately operated emergency response vehicle, should be deemed as non-discriminatory serving sites in that they would provide security services for all addresses for which they have been contracted.

The advantages of the security system 100 are best understood in the context of non-discriminatory and discriminatory serving sites, both of which provide security services to sites. For example, the monitored site 110 may be one home in a subdivision comprised of many homes, the remainder of which are unmonitored sites. All of the homes in the subdivision enjoy the services of the non-discriminatory serving sites, here, the public safety call center 140 and the emergency response vehicle 150. In contrast, the home which is the monitored site 110 also enjoys the services of the discriminatory serving sites, here, the central monitoring station 130 and the data center 180.

Continuing to refer to FIG. 1, the monitored site 110 will now be described in greater detail. As may now be seen, FIG. 1 shows a single monitored site, specifically, the monitored site 110, being monitored by the central monitoring station 130 and the data center 180. It should be clearly understood, however, that the central monitoring station 130 and the data center 180 are capable of simultaneously monitoring any number of additional sites not shown in FIG. 1 for ease of illustration. Installed at various locations within the monitored site 110 are any number and type of alarm information collection devices 111, 112 and 113. As disclosed herein, the alarm information collection devices 111 are various types of sensors, for example, magnetic contact switches, audio sensors, infrared sensors, motion detectors, fire alarms and carbon monoxide detectors, the activation of which indicates an alarm condition at the monitored site 110. The alarm information collection devices 112 are video cameras, each capable of recording video images of a selected area of the monitored site 110. If desired, the video cameras 112 may be configured with a field of vision which enables each video camera 112 to capture video images over a wide area. For example, it is contemplated that a field of vision ranging between 180° and 360° would enable the video cameras 112 to capture video images over a suitably wide area. Typically, to provide the video cameras 112 with such a field of vision, the video camera is typically mounted on a platform configured for movement along a generally horizontal axis. To further enhance the field of vision of the video cameras 112, the platform may be further configured for movement along a generally vertical axis. Preferably, the video cameras would be equipped to perform any number of functions, including, but not limited to, pan, tilt, zoom, focus, aperture and white balance functions. Finally, the alarm information collection devices 113 are audio stations, each capable of recording audible sounds occurring within a selected area of the monitored site 110 and optionally capable of delivering audio from remote locations to the selected area. Preferably, the audio stations would be equipped to perform any number of functions, including, but not limited to, adjusting microphone sensitivity and adjusting speaker volume. While it is fully contemplated that the video cameras 112 and the audio stations 113 may be configured to record video and audio in a storage medium forming part of the video cameras 112 and audio stations 113, respectively, for later download to a target device, for example, security gateway 115, in the embodiment of the invention disclosed herein, it is contemplated that both the video cameras 112 and audio stations 113 be configured to capture video and audio data, respectively, for immediate transmission to the target device, again, for example, security gateway 115.

Of course, the foregoing are but a rudimentary example of the wide variety of alarm information collection devices which may be installed at selected locations within the monitored site 110. Regardless of the particular type of alarm information collection device employed at the monitored site 110, it should be noted that many such alarm information collection devices may be generally characterized as being configured to either (1) detect and report, to a remotely located site, the occurrence of a selected type of event at a monitored site; (2) collect information related to a detected occurrence of a selected type of event at a monitored site and forward the collected information to a remote site; (3) deliver, from a remote site, information, typically, audio information intended to elicit further information, to a monitored site; or (4) perform a combination of items (1), (2) and/or (3). It should be further noted that, while FIG. 1 shows first, second and third ones of each type of alarm information collection device 111, 112 and 113 are installed at selected locations within the monitored site 110, it is fully contemplated that the security system 100 may instead include any combination of types of alarm information collection devices and/or any number of each such type of alarm information collection device. Finally, it should be noted that the functions performed by respective types of the illustrated alarm information collection devices may be incorporated into a single alarm information collection device. For example, many video cameras may have a motion sensor incorporated therein such that the video camera begins recording whenever motion is detected. Similarly, audio stations are often built into a video camera such that video and audio recording are simultaneously initiated.

Typically, the alarm information collection devices 111, 112 and 113 are installed at selected locations within the monitored site 110 and integrated with one another such that selected ones of the alarm information collection devices 111, 112 and 113 will execute selected functions in response to the detection of selected conditions by others of the alarm information collection devices 111, 112 and 113. For example, the sensor 111 may be a contact sensor installed on a door frame while the video camera 112 and the audio station 113 are mounted in the entryway to which the door leads. When the sensor 111 detects that the door has been opened, the video camera 112 and the audio station 113 begin recording video and audio data, respectively, for an area of the monitored site 110 which encompasses the entryway to which access is being sought, thereby capturing video images and audio of the person or persons accessing the entryway.

The alarm information collection devices 111, 112 and 113 are integrated with one another by a security gateway 115 to which each of the alarm information collection devices 111, 112 and 113 are coupled. While, as disclosed herein, the security gateway 115 is typically located at the monitored site 110, if desired, it is fully contemplated that the security gateway 115 may be located elsewhere, for example, at the central monitoring station 130. The security gateway 115 is coupled to each monitoring device 111, 112 and 113 installed at the monitored site 110. For example, conductive wires may be used to electrically connect each alarm information collection device 111, 112 and 113 to an alarm control panel (not shown) built into the security gateway 115. Alternately, of course, the alarm information collection devices 111, 112 and 113 may be wirelessly coupled to the security gateway 114. Accordingly, it should be clearly understood that, as used herein, the terms "coupled" and "operatively coupled" are merely intended to mean that the devices are connected in such a way that data and control signals may be exchanged therebetween. It should be further understood that devices "coupled" or "operatively coupled" to one another do not require a direct connection, a wired connection, or even a permanent connection. Rather, for purposes of the present invention, it is sufficient that the connection be established for the purpose of exchanging information.

In addition to associating selected ones of the alarm information collection devices 111, 112 and 113 to one another, the security gateway 115 also functions as an interface between the various components of the security system 100 installed at the monitored site 110 and the various sites, here, the data center 180, the central monitoring station 130, the public safety call center 140 and the emergency response vehicle 140, serving the monitored site 110. Thus, and as will be more fully described below, the security gateway 115 delivers alarm information, typically in the form of an alarm signal indicating detection of an alarm condition at the monitored site 110, accompanied by a near real-time stream of alarm video and/or audio data, to the data center 180. As used herein, the term "near real-time" is intended to generally refer to those situations where the alarm video and/or audio is transported from the monitored site 110 to the data center 180 with sufficiently low delay between the capture of the event by the alarm video and/or audio and the receipt of the alarm video and/or audio by the data center 180 to support timely assessment of the probable utility and risks associated with actions such as entry of the monitored premises by emergency response personnel. Finally, while it is preferred that the alarm video transported to the data center 180 be full-motion video, it is fully contemplated that, in some situations, particularly when insufficient bandwidth is available on the data network 120, the alarm video may instead be comprised of one or more still pictures.

Finally, the security gateway 115 may use the video from the video camera 112 to assist in determining whether an alarm condition exists at the monitored site 110. For example, in one embodiment, the sensor 111 may be an intelligent alarm module, integrated with the video camera 112, capable of detecting motion or intrusion by analyzing the video image generated by the video camera 112. In another embodiment, the security gateway 115 may be configured to analyze images detected by the video camera 112 and/or audible sounds detected by the audio station 113 and determine, based upon the detected images and/or audible sounds, if an alarm condition exists at the monitored site 110. If desired, the sensitivity of the sensors 111 may be adjusted to limit activation of the sensors 111 to those conditions considered more likely to be indicative of an alarm condition. For example, the sensors 111 may be adjusted to trigger an alarm if a person walks across a monitored area but not to trigger an alarm if a dog walks across the same area.

Also installed at the monitored premises 110 is a user interface 114, for example, a keypad, which, like the alarm information collection devices 111, 112 and 113, is coupled to the security gateway 115. The keypad 114 serves as the user interface to the security system 100 generally and the security gateway 115 specifically. While a wide variety of user-controllable functions may be actuated by a user operating the keypad 114, most commonly, such functions would include the ability to arm/disarm the monitored site 110 and to configure (or reconfigure) the alarm information collection devices 111, 112 and 113, for example, to disable a selected monitoring device believed to be faulty. It is further contemplated that the keypad 114 may be equipped with any number of other features as well. For example, it is often desirable that an operator at the central monitoring station 130 is able to conduct a two-way audio exchange with the person or persons at the monitoring site 110. While it is fully contemplated that any of the alarm information collection devices, in particular, the audio recording devices 113, may be configured to receive audio in addition to any other functions performed thereby, it is further contemplated that that the keypad 114 may also (or instead) be equipped to conduct a two-way audio and/or a two-way video exchange with an operator at the central monitoring station 130.

The security gateway 115 includes a processor (not shown) which controls the alarm information collection devices 111, 112 and 113 in accordance with a predetermined set of criteria and a memory (also not shown) which records alarm information received from the alarm information collection devices 111, 112 and 113. For example, the processor of the security gateway 115 may be continuously receiving video data from the video cameras 112 and/or audio data from the audio stations 113, temporarily storing the received video and/or audio data for a preselected time period in the memory and, upon expiration of the preselected time period without receipt of an alarm signal indicating detection of an alarm condition, deleting the received video and/or audio data from the memory, for example, by overwriting the video and/or audio data with newly received video and/or audio data. If, however, the sensor 111 is activated during this time period and an alarm signal received by the security gateway 115, the security gateway 115 retrieves an alarm video and/or alarm audio from the stored video and/or audio data and transports the alarm signal, the alarm video and/or the alarm audio to the data center 180 over the data network 120. The security gateway 115 will then begin streaming near real-time video and/or audio from video camera 112 and/or audio station 113 to the data center 180, again, over the data network 120. Of course, the foregoing is but a rudimentary explanation of the functions which are performed by the security gateway 115 deemed sufficient for an understanding of the present invention and it is noted that much more complete descriptions of the functions which are performed by the security gateway 115 are set forth in co-pending U.S. patent application Ser. No. 10/603,508 filed Jun. 25, 2003 and Ser. No. 10/607,006 filed Jun. 26, 2003, each of which is hereby incorporated by reference as if reproduced in its entirety.

As to be more fully described below, the discriminatory serving sites, specifically, the central monitoring station 130 and the data center 180 monitor the served site 110, which, for example, may be a private residence or commercial business, using the alarm information received from the security gateway 115. Broadly speaking, certain security functionality resides within each of discriminatory serving sites, more specifically, the central monitoring station 130 and the data center 180 which enable these sites to monitor the served site 110. The data center 180 is configured to automate certain aspects of the security system 100. It receives alarm information, including a near real-time alarm video and/or audio stream related to an alarm condition detected at the monitored site 110, for processing. At the data center 180, the alarm signal is logged and, if available, additional information, for example, information on prior alarm signals, regarding the monitored site 110 is retrieved. The data center 180 then transports alarm information, over the data network 120, to the central monitoring station 130 for use by an operator to determine if an actual alarm condition exists at the monitored site 110. Variously, alarm information may include the received alarm signal, the near real-time alarm video and/or audio stream and/or additional information retrieved by the data center 180. The data center 180 also authenticates remote users (not shown) such that authenticated remote users may directly access the monitored site 110 via the data network 120. Finally, the data center 180 is also equipped with functionality capable of recognizing the detection of multiple alarm conditions at the monitored site 110 and for checking on the operation of the various components of the security system 100 installed at the monitored site 110.

The data center 180 provides a wide variety of security services to the monitored site 110. As may be seen in FIG. 1, the data center 180 is a discrete site, remotely located relative to the monitored site 110, having one or more servers coupled to the data network 120. As disclosed herein, the data center 180 includes a security system server 182 and a shared control server 184, each of which is coupled to the data network 120. It should be clearly understood, however, that, as described and illustrated herein, the security system server 182 and the shared control server 184 have been greatly simplified for ease of description and various software components thereof and the tasks performed thereby which are not deemed necessary to an understanding of the present invention have been omitted from the foregoing description. It should be noted, however, additional ones of the various tasks to be performed by the security system server 182 which have been omitted from the foregoing description may be found by reference to co-pending U.S. patent application Ser. No. 10/607,008 filed Jun. 26, 2003 and hereby incorporated by reference as if reproduced in its entirety.

Briefly, however, among the tasks to be performed by the security system server 182 is the task of relaying the alarm information received from the security gateway 115 to the central monitoring station 130. The shared control server 184, on the other hand, coordinates management of the near real-time video and/or audio stream to be received from the security gateway 115 by the various operators, dispatchers and/or managers who, as will be more fully described below, may selectively control certain aspects of the alarm-related video and/or audio data stream being received in near real-time. Of course, while FIG. 1 shows the security system server 182 and the shared control server 184 discretely coupled to the data network 120, more typically, the security system server 182 and the shared control server 184 would share an interconnection with the data network 120, for example, using an appropriately sized trunk. The security system server 182 and the shared control server 184 would also be interconnected to one another by a local area network ("LAN") 186 shielded from the data network 120 by a firewall (not shown).

The central monitoring station 130 also provides a wide variety of security services to the monitored site 110. As may be further seen in FIG. 1, the central monitoring station 130 is a discrete site, remotely located relative to the monitored site 110, having one or more computer workstations coupled to the data network 120. As disclosed herein, the central monitoring station 130 includes a first (or "operator") workstation 132, a second (or "central station manager") workstation 134 and a third (or "application administration") workstation 136. Preferably, each one of the operator, central station manager and application workstations 132, 134 and 136 may be comprised of a suitably sized computer system, for example, a personal computer ("PC") or other desktop computer having a platform, for example, the Windows 2000 platform commercially available through Microsoft Corporation of Redmond Wash., equipped with a graphical user interface ("GUI") for interacting with software applications executing on the PC.

As will be more fully described below, from the operator workstation 132, an operator will: (1) receive alarm information from the monitored site 110; (2) evaluate the received alarm information to determine the likelihood that emergency assistance is required at the monitored site 110; (3) establish a voice connection with a dispatcher at the public safety call center 140 over PSTN 160 and/or establish a voice connection with a field responder operating the emergency response vehicle 150 over wireless voice network 170; and (4) share the near real-time video and/or audio feed portion of the received alarm information with the dispatcher at the public safety call center 140 or the field responder operating the emergency response vehicle 150 by making the near real-time video and/or audio feed portion of the received alarm information available to a dispatcher operating a dispatcher workstation 142 at the public safety call center 140 or a field responder operating a field responder workstation 155. While the field responder workstation 155 is typically located within the emergency response vehicle 150, it is fully contemplated that, in the alternative, the field responder workstation 155 may be positioned at other locations. For example, the field responder workstation 155 may be positioned on the person of the field responder.

Once the operator has, from the operator workstation 132, shared the near real-time video and/or audio feed portion of the received alarm information with either the dispatcher at the dispatcher workstation 142 or the field responder at the field responder workstation 155, the operator may either maintain control over the near real-time video and/or audio feed or may cede control of the feed to the dispatcher or field responder. Whoever controls the near real-time video and/or audio feed also controls the functionality with which the video camera and/or audio station at which the near real-time video and/or audio feed originates is equipped. Examples of the types of functionality which may be controlled from the computer workstation controlling the near real-time video and/or audio feed include repositioning, to a different field of view, the video camera 112 from which the video feed is originating, switching the video feed to another one of the video cameras 112 or switching the audio feed to another one of the audio station 113. If control is ceded to either the dispatcher and/or the field responder, the operator may subsequently reassert control over the alarm information.

From the central monitoring station manager workstation 134, a computer user, typically, a manager or other person acting in a supervisory role relative to the operators, may perform certain supervisory functions relative to the sharing of near real-time video and/or audio feeds with the public safety call center 140 and/or the emergency response vehicle 150. These supervisory functions include selectively suspending the sharing of one, plural or all video and/or audio feeds with the public safety call center 140 and/or the emergency response vehicle 150. For example, from the central monitoring station manager 134, the manager would monitor the video and/or audio feeds being shared with the public safety call center 140 and/or the emergency response vehicle 150 and may periodically opt to suspend those video and/or audio feeds which appear to be shared as a result of an administrative error or if the manager of the central monitoring station 130 believes there are compelling reasons to suspend the video and/or audio feeds, for example, if the video and/or audio feeds are interfering with privacy rights of a person at the monitored site 110. The manager of the central monitoring station 130 may also re-enable previously suspended video and/or audio feeds, again, from the central monitoring station manager workstation 134.

From the application administration workstation 136, a network administrator for the security system 100 may perform selected management functions related to the sharing of video and/or audio feeds. Among these tasks would be a mapping of each monitored site, for example, the monitored site 110, to a selected public safety call center, for example, the public safety call center 140. For example, depending on their respective geographical location, a first monitored site may be served by a public safety call center different from the public safety call center serving a second monitored site. As a result, the network administrator must associate each monitored site with a public (or private, if appropriate) safety call center and store that association at the security system server 182. Subsequently, when an operator begins receiving alarm information from that monitored site, the operator will review the identifying information associated with the received alarm information, retrieve the profile associated with the monitored site from the security system server 182 and, if sharing of the received video and/or audio feed is appropriate, establish connection with the public or private safety call center associated with the monitored site.

Of course, while FIG. 1 shows first, second and third computer workstations 132, 134 and 136, discretely coupled to the data network 120, more typically, the first, second and third computer workstations 132, 134 and 136 would share an interconnection with the data network 120, for example, using an appropriately sized trunk. The first, second and third computer workstations 132, 134 and 136 would also be interconnected to one another by a LAN 138 shielded from the data network 120 by a firewall (not shown). Furthermore, the present disclosure of the central monitoring station 130 as having first, second and third computer workstations 132, 134 and 136 is purely by way of example and it is fully contemplated that the central monitoring station 130 may instead be configured to include any number of computer workstations. For example, it is specifically contemplated that the central monitoring station 130 would include plural operator workstations 132, the precise number of which will vary depending on the number of sites being monitored by the central monitoring station 130. The number of central station manager workstations 134, on the other hand, will vary depending on the number of operator workstations 132 which can be properly supervised by each central station manager workstation 134. For example, if a maximum of ten operator workstations 132 can be properly supervised by each central station manager workstation 134, then a second central station manager workstation 134 is added when the number of operator workstation exceeds ten but remains below twenty.

Like the central monitoring station 130, the public safety call center 140 also provides a wide variety of security services to the monitored site 110. As disclosed herein, the public safety call center 140 is a centralized site which handles all "911" calls requesting police, fire, medical or other type of emergency assistance within a defined geographical area. For those geographical areas lacking a centralized site for processing multiple types of emergency calls, a specified public facility, for example, the sheriff's office for a rural county, may receive the video and/or audio feeds instead of the public safety call center 140 illustrated in FIG. 1. With the increasing popularity of gated communities and/or the use of private safety personnel in both gated and ungated communities as a supplement to the limited public safety personnel available to protect that community, a facility operated by a private security company may receive video and/or audio feeds instead of the public safety call center 140 illustrated in FIG. 1. Facilities operated by private security companies would also be more likely to receive video and/or audio feeds originating at commercial facilities which, as is well known in the art, have traditionally relied upon private security companies to a much greater extent than personal residences.

It should also be noted that FIG. 1 shows a single public safety call center 140 coupled to the data network 120 purely for ease of illustration and it is specifically contemplated that plural public safety call centers 140 may instead be coupled to the data network 120. For example, many geographical regions are divided into plural entities such as cities or towns. Typically, each city and town is responsible for providing emergency response services within its respective borders. As a result, each city or town in a geographical area may have its own public safety call center. Similarly, larger cities may have multiple public safety call centers, each responsible for a particular part of town. For example, if the security system 100 includes a first monitored site in one city and a second monitored site in an adjacent city, the security system 100 would further include a first public safety call center which serves the first city with which the central monitoring station 130 would share the video and/or audio feed originating from the first monitored site upon occurrence of an alarm condition at the first monitored site and a second public safety call center which serves the adjacent city with which the central monitoring station 130 would share the video and/or audio feed originating from the second monitored site upon occurrence of an alarm condition at the second monitored site.

In the embodiment disclosed in FIG. 1, the public safety call center 140 includes a first (or "dispatcher") workstation 142 and a second (or "public safety manager") workstation 144. Preferably, each of the dispatcher and public safety manager workstations 142 and 144 may be comprised of a suitably sized computer system, for example, a PC or other desktop computer having a platform, for example, the Windows 2000 platform, equipped with a GUI for interacting with software applications executing on the PC. As will be more fully described below, from the dispatcher workstation 142, a video and/or audio feed originating at the monitored site 110 may be viewed if the operator workstation 132 at the central monitoring station 130 has made the feed available for viewing. Also, if the operator workstation 132 has ceded control over the video and/or audio feed to the dispatcher workstation 142, the dispatcher workstation 142 may issue commands which control the received feed, for example, by instructing the video camera at which the feed originates to pan or to switch the feed to another video camera located within the monitored site 110. As will also be more fully described below, from the public safety manager workstation 144, the video and/or audio feed being viewed at the dispatcher workstation 142 may be suspended. For example, it may be appropriate for the video and/or audio feed to be suspended if the public safety manager operating the public safety manager workstation 144 believes that the video and/or audio feed is being shared in error or if there are compelling reasons for the video and/or audio feed to be suspended at the public safety call center. Again, for example, the public safety manager may decide to suspend the video and/or audio feed if it apparent that the video and/or audio feed is violating the right of privacy of one or more individuals at the monitored site. Finally, video and/or audio feeds being transmitted to the dispatcher workstation 142 which had been previously suspended by the public safety manager may also be re-established from the public safety manager workstation 144.

Of course, while FIG. 1 shows the dispatcher workstation 142 and the public safety manager workstation 144 discretely coupled to the data network 120, more typically, the dispatcher workstation 142 and the public safety manager workstation 144 would more likely share an interconnection with the data network 120, for example, using an appropriately sized trunk. The dispatcher workstation 142 and the public safety manager workstation 144 would also be interconnected to one another by a LAN 146 shielded from the data network by a firewall (not shown). Furthermore, it should be clearly understood that the present disclosure of the public safety call center as having a single dispatcher workstation 142 and a single public safety manager workstation 144 is purely by way of example and it is fully contemplated that the public safety call center may include any number of each of these types of workstations. Generally, however, the number of dispatcher workstations 142 will be determined based upon the volume of emergency calls received by the public safety call center 140 and the number of dispatchers required to handle the calls. The number of public safety manager workstations 144, on the other hand, will vary depending on the number of dispatcher workstations 142 which can be properly supervised by each public safety manager workstation 144. For example, if a maximum of ten dispatcher workstations 142 can be properly supervised by each public safety manager workstation 144, then a second public safety manager workstation is added when the number of dispatcher workstation exceeds ten but remains below twenty.

Like the central monitoring station 130 and the public safety call center 140, the emergency response vehicle 150 provides a wide variety of security services to the monitored site 110. As disclosed herein, the emergency response vehicle 150 is a geographically mobile unit, for example, a police car, fire truck or ambulance, which, in response to audible instructions issued by one of the dispatchers at the public safety call center 140 over a radio link (not shown), will travel to the monitored site 110 to investigate the alarm condition and provide assistance as needed. It should be noted that FIG. 1 shows an emergency response vehicle 150 coupled to the data network 120 purely for ease of illustration and it is specifically contemplated that plural emergency response vehicles may instead be coupled to the data network 120. For example, at any particular time, a police force for a city may have any number of emergency response vehicles on patrol with the city.

In the embodiment disclosed in FIG. 1, the emergency response vehicle 150 includes a field responder workstation 155. Typically, the field responder workstation 155 will be a ruggedized laptop computer, securedly mounted within the emergency response vehicle 150, having a platform, for example, the Windows 2000 platform, equipped with a GUI for interacting with software applications executing on the laptop computer. Again, as will be more fully described below, a video and/or audio feed originating at the monitored site 110 may be viewed if the video and/or audio feed has been made available for viewing at the field responder workstation 155 by whichever entity has control over the video and/or audio feed. Thus, if control over the video and/or audio feed had previously been ceded to the dispatcher workstation 142, the dispatcher workstation 142 would be responsible for making the video and/or audio feed available at the field responder workstation 155. Conversely, if the operator workstation 132 had maintained control over the video and/or audio feed, the operator workstation 132 at the central monitoring station 130 would be responsible for making the video and/or audio feed available for viewing at the field responder workstation 155. Typically, a verbal exchange with the emergency response personnel occurs immediately prior to the operator or dispatcher making the video and/or audio feed available at the field responder workstation 155. The dispatcher would engage in such an exchange over a dedicated radio link (not shown) while the operator would engage in such an exchange over a wireless voice network ("WVN") 170.

Similar to when control of the video and/or audio feed was ceded to the dispatcher workstation 142, upon ceding control over the video and/or audio feed to the field responder workstation 155, the field responder workstation 155 may issue commands which control the received feed, for example, by instructing the video camera at which the feed originates to pan or to switch the feed to another video camera located within the monitored site 110. Again as before, the video and/or audio feed being viewed at the field responder workstation 142 may be suspended and/or re-established from the public safety manager workstation 144 or the central station manager workstation 134.

Figure 2:
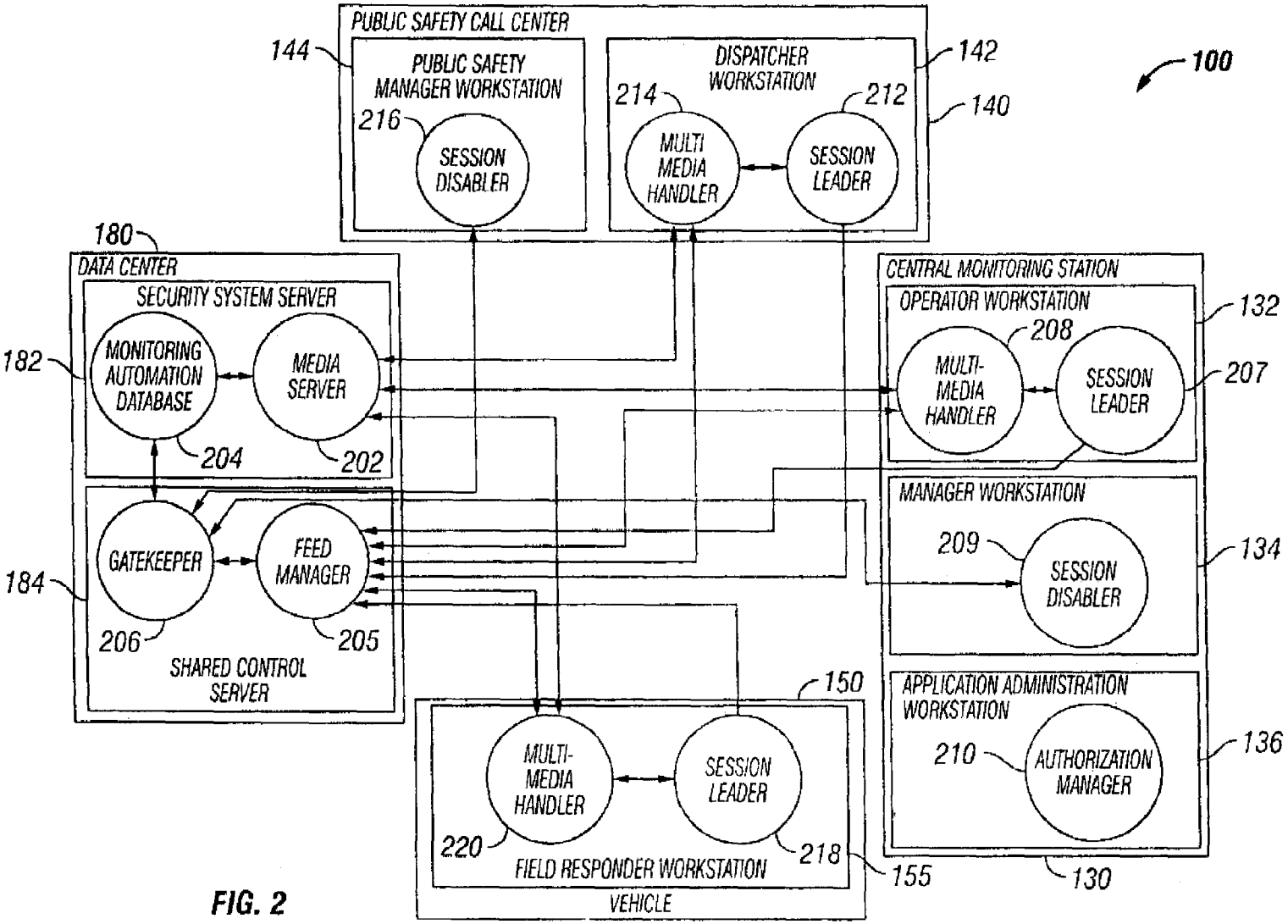
FIG. 2 is an expanded block diagram of selected portions of the security system of FIG. 1.

Further details regarding the configuration of the security system 100 may be seen by reference to FIG. 2. As may now be seen, each of the servers and/or workstations physically located at either the data center 180, central monitoring station 130, public safety call center 140 and emergency response vehicle 150 has at least one software module residing therein. More specifically, each one of the security server 182, shared control server 184, operator workstation 132, central monitoring station manager workstation 134, application administration workstation 136, dispatcher workstation 142, public safety manager workstation 144 and field responder workstation 155 includes at least one memory subsystem (not shown) in which one or more software modules are stored and at least one processor subsystem for executing the one or more software modules stored in the memory subsystem. As disclosed and illustrated herein, each software module forms part or all of a software application and is comprised of one or more lines of code which is executable by the processor subsystem. For those servers and/or workstations disclosed as having multiple software modules, it is contemplated that, rather than forming part of the discrete software modules shown in the drawings, the executable code for the multiple software modules may instead be included in a single software module.

Residing on the security system server 182 in the data center 180 is a media server 202 and a monitoring automation database 204. The media server 202 serves as an interface between, on one side, the monitored site 110 and the functionality residing at the data center 180 which relates to the acquisition and storage of alarm information and, on the other side, the remaining serving sites of the security system 100, here, the central monitoring station 130, the public safety call center 140 and the emergency response vehicle 150. Thus, as will be more fully described below, the near real-time alarm video and/or audio feed, as well as other types of alarm information selected for distribution to one or more of the central monitoring station 130, the public safety call center 140 and/or the emergency response vehicle 150 are distributed through the media server 202. Similarly, regardless of whether they originate at the central monitoring station 130, the public safety call center 140 or the emergency response vehicle 150, any commands which would modify the near real-time alarm video and/or audio feed, for example, by instructing the security gateway 115 to pivot the video camera 112 generating the video, or acquire additional alarm information, for example, downloading a prior alarm video stored in the monitoring automation database 204, are handled by the media server 202. Also, audio originating at the central monitoring station 130, the public safety call center 140 or the emergency response vehicle 150 and destined for the monitored site 110 is relayed through the media server 202. Finally, the media server 202 stores video and/or audio data associated with prior alarm events.

The monitoring automation database 204 stores and/or retrieves customer data, for example, contact information, billing information, passwords, and alarm information in a database (not shown). As will be more fully described below, the monitoring automation database 204 also maintains, for use by gatekeeper module 206, a current list of monitored sites in alarm condition and a list of permissions which define the conditions under which the near real-time video and/or audio feed from the monitored site 110 may be made available to and/or placed under the control of the public safety call center 140 and/or the emergency response vehicle 150.

Residing on the shared control server 184 of the data center 180 is a first (or "feed manager") software module 205 and a second (or "gatekeeper") software module 206. The feed manager software module 206 acts as an interface between an instance of a session leader software module residing on one of the serving sites, here, either the central monitoring station 130, the public safety call center 140 or the emergency response vehicle 150, and instances of a multi-media handler software module residing on each one of the aforementioned serving sites to which the near real-time alarm video and/or audio has been made available. More specifically, selected functionality which would enable multi-media handler software modules residing on the operator workstation 132, the dispatcher workstation 142 and the field responder workstation 155 to modify the near real-time alarm video and/or audio feed received from the media server 202 has been offloaded to the feed manager software module 205. When an instance of a session leader module is executed by either the operator workstation 132, the dispatcher workstation 142 or the field responder workstation 155, to modify the near real-time alarm video and/or audio feed, the instance of the session leader software module will issue the request for modification to the feed manager software module 205. In turn, the feed manager software module 205 will provide the commands necessary for each instance of the multi-media handler software module being executed to acquire, from the media server 202, the modified near real-time alarm video and/or audio feed.

The feed manager software module 205 also serves to enable instances of multi-media handlers which retrieve the near real-time alarm video and/or audio feed from the media server 202. For example, if the operator at the operator workstation 132 decides to make a particular near real-time alarm video and/or audio feed being receive at the operator workstation 132 available to another serving site, for example, to the dispatcher at the dispatcher workstation 142, the operator issues a command to multi-media handler software module 208 identifying the subject near real-time alarm video and/or audio feed and one or more dispatchers eligible to receive the feed. In turn, the multi-media handler software module 208 passes the command to the feed manager software module 205. In turn, the feed manager software module 205 checks with the gatekeeper software module 206 to determine if the identified one or more dispatcher has the necessary permissions to receive the identified near real-time video and/or audio feed. If the gatekeeper software module 206 determines that the one or more dispatcher has the requisite permissions to view the identified near real-time video and/or audio feed, the gatekeeper software module 206 will authorize execution of the command received by the feed manager software module 205 which in turn, will provide a multi-media handler instance 214 associated with each of the one or more eligible dispatchers with the command information necessary to pull the near real-time alarm video and/or audio feed from the media server 202. If, however, the gatekeeper software module 206 determines that the one or more dispatchers lack the requisite permissions to view the requested near real-time video and/or audio feed, the gatekeeper software module 206 will instruct the feed manager software module 205 to refuse the command. If the gatekeeper software module 206 disapproves of the command, the feed manager software module 205 will advise the multi-media handler software module 208 that the one or more dispatchers lack the necessary permissions to view the near real-time video and/or audio feed.

The gatekeeper software module 206 provides both authorization and command functionality to the security system 100. The authorization functionality provided by the gatekeeper software module 206 involves confirmation as to whether the public safety call center 140, the emergency response vehicle 150 or another serving site is authorized to passively receive and/or actively receive the near real-time alarm video and/or audio feed from the media server 202. The command functionality provided by the gatekeeper software module 206 involves the issuance of commands to the feed manager software module 205 to either disable an enabled feed or re-enable a disabled feed being received by either the multi-media handler software module 208 residing at the operator workstation 132, the multi-media handler software module 214 residing at the dispatcher workstation 142 or the multi-media handler software module 220 residing at the field responder workstation 155.

Residing on each one of the operator, dispatcher and field responder workstations 132, 142 and 155 is a first (or "session leader") software module 207, 212 and 218 and a second (or "multi-media handler") software module 208, 214 and 220, respectively. Of course, while FIG. 2 shows an instance of the session leader software module being executed on each one of the operator, dispatcher and field responder workstations 132, 142 and 155, it should be clearly understood that, at any given time, only one of the workstations 132, 142 and 155 may be executing its instance of the session leader software module. As will be more fully described below, the operator workstation 132 is selected as the initial session leader. Accordingly, upon the multi-media handler software module 208 receiving alarm information from the media server 202, the multi-media handler software module 208 initiates execution of the session leader software module 207.

Using the operator workstation 132, the operator, as session leader, may exercise a wide variety of controls over the near real-time video and/or audio feed being received thereby. For example, the operator may subsequently decide to: (1) make the near real-time alarm video and/or audio feed available to either the dispatcher at the dispatcher workstation 142 or the emergency response personnel at the field responder workstation 155; and possibly (2) cede control of the near real-time alarm video and/or audio feed to either the dispatcher at the dispatcher workstation 142 or the emergency response personnel at the field responder workstation 155.

To make the near real-time video and/or audio feed available at another workstation, the operator would issue a "make feed available" command to the multi-media handler software module 208 using the GUI of the operator workstation 132. The "make feed available" command would identify the near real-time video and/or audio feed to be made available at another workstation and the workstations eligible to receive the near real-time video and/or audio feed. In turn, the multi-media handler software module 208 passes the received command and workstation identifiers to the feed manager software module 205. The feed manager software module 205 checks the permissions maintained by the gatekeeper software module 206 to determine if the workstations identified as eligible recipients of the near real-time video and/or audio feed have been authorized to receive the feed. If the identified workstations have been authorized to receive the feed, the feed manager software module 205 provides the multi-media handler software module residing at the identified workstations with the necessary instructions that will allow the workstations to begin receiving the feed on demand.

To cede control of the near real-time video and/or audio feed to another workstation, the operator would issue a "cede feed control command" to the session leader software module 207, again using the GUI of the operator workstation 13. The "cede feed control" command would identify the near real-time video and/or audio feed for which control is to be ceded together with an identifier of the workstation which will assume control of the feed. In turn, the session leader software module 207 passes the received command and workstation identifier to, the feed manager software module 205. The feed manager software module 205 checks the permissions maintained by the gatekeeper software module 206 to determine if the workstation identified as the intended recipient of control of the near real-time video and/or audio feed has been authorized to receive the near real-time alarm video and/or audio feed. If the identified workstation has been authorized to take control of the feed, the feed manager software module 205 notifies the multi-media handler software module residing at the identified workstation that the workstation is to take control of the feed. In turn, the multi-media handler software module initiates execution of the instance of the session leader software module residing at the identified workstation.

For example, the session leader software module 207 residing at the operator workstation 132 may advise the feed manager software module 205 that it wishes to cede control to the dispatcher workstation 142. If, upon inquiry by the feed manager software module 205, the gatekeeper software module 206 confirms that control of the feed may be ceded to the dispatcher workstation 214, the feed manager software module 205 notifies the multi-media handler software module 214 that the dispatcher workstation 142 is to assume control of the feed. The multi-media handler software module 214 initiates execution of the session leader software module 212. The multi-media handler software module 214 will notify the feed manager software module 205 upon successful execution of the session leader software module 212 and, in turn, the feed manager software module 205 will instruct the multi-media handler software module 208 to close the session leader 207.

Examples of other controls which may be exercised by the operator as session leader include (1) terminate shared feed; (2) modify shared feed; (3) partial clear alarm; and (4) full clear alarm. Of course, it should be clearly understood that the foregoing list of other controls is by no means intended to be exhaustive and it is fully contemplated that other controls not specifically enumerated herein may also be exercised by the operator as session leader. Of the controls specifically enumerated herein, the "terminate shared feed" control is used if either the dispatcher notifies the operator that the shared feed is no longer needed or the operator independently decides that the dispatcher no longer needs the shared feed. To execute this control, the multi-media handler software module 208 would notify the feed manager software module 205 to cause the multi-media handler software module 214 to terminate pulling the video and/or audio feed, for example, by no longer supplying the multi-media handler software module 214 with the information necessary to continue pulling the video and/or audio feed from the media server 202.

The "modify shared feed" control incorporates a number of control functions which may be exercised by the operator as session leader. These controls include camera selection, review of stored video and/or audio, whether non-alarm, pre-event or post-event video and/or audio, associated with alarm events, intercom microphone and speaker selection, adjustment of intercom microphone sensitivity and intercom speaker volume. Commands related to these and other "modify shared feed" controls are generated by the session leader software module 207 and passed to the feed manager software module 205. In turn, the feed manager software module 205 advises each multi-media handler software module, for example, the multi-media handler software module 214, of the changes in the video and/or audio feed to be pulled from the media server 202.

By exercising the "partial clear" control, the video and/or audio feed to the operator is terminated. However, the alarm is kept active. This control is used when continuous involvement by the operator is no longer needed, for example, after a dispatcher has been contacted, but additional information, for example, the situation observed by the emergency response personnel upon arrival at the monitored site 110, is necessary before the alarm condition is closed. However, the operator is now free to address other alarm conditions while awaiting the additional information needed before closing the current alarm condition. Conversely, by exercising the "full clear" control, the video and/or audio feed to the operator is terminated and the alarm closed out. Additionally, the full clear control terminates all other feeds from the monitored site 110, including those being delivered to the dispatcher workstation 142 and/or field responder workstation 155.

Residing on each of the manager workstation 134 and the public safety manager workstation 144 is a first (or "session disabler") software module 209 and 216, respectively. For example, the session disable software module 209 may include a Java applet served up by a web page on the shared control server 184 and may list all on-going alarm events for which a near real-time video and/or audio feed has been made available to dispatchers and/or field responders by central station operators and have not been blocked by a central station manager. When the central station manager first executes the session disabler software module 209 using the GUI for the manager workstation 134, the session disabler software module 209 will generate a list of these alarm events. In the event that the central station manager decides to block access to one of the video and/or audio feeds that is currently available to dispatchers and/or field responders, the central station manager will issue a "block feed command", together with an identifier of the feed to be blocked and the dispatcher and/or field responder workstation for which the feed is to be blocked, to the session disabler software module 209, again using the GUI of the manager workstation. In turn, the session disabler software module 209 will transmit the command to the gatekeeper software module of the shared control server 184 via the data network 120. After receiving the "block feed command" from the session disabler software module 209, the gatekeeper software module 206 will instruct the feed manager software module 205 to block the identified dispatcher and/or field responder workstation from receiving the identified near real-time video and/or audio feed. In turn, the feed manager software module will contact the multi-media handler software module residing at each identified workstation and instruct the contacted multi-media handler software module to stop pulling the near real-time video and/or audio fed from the media server 202.

Figures 1, 3:
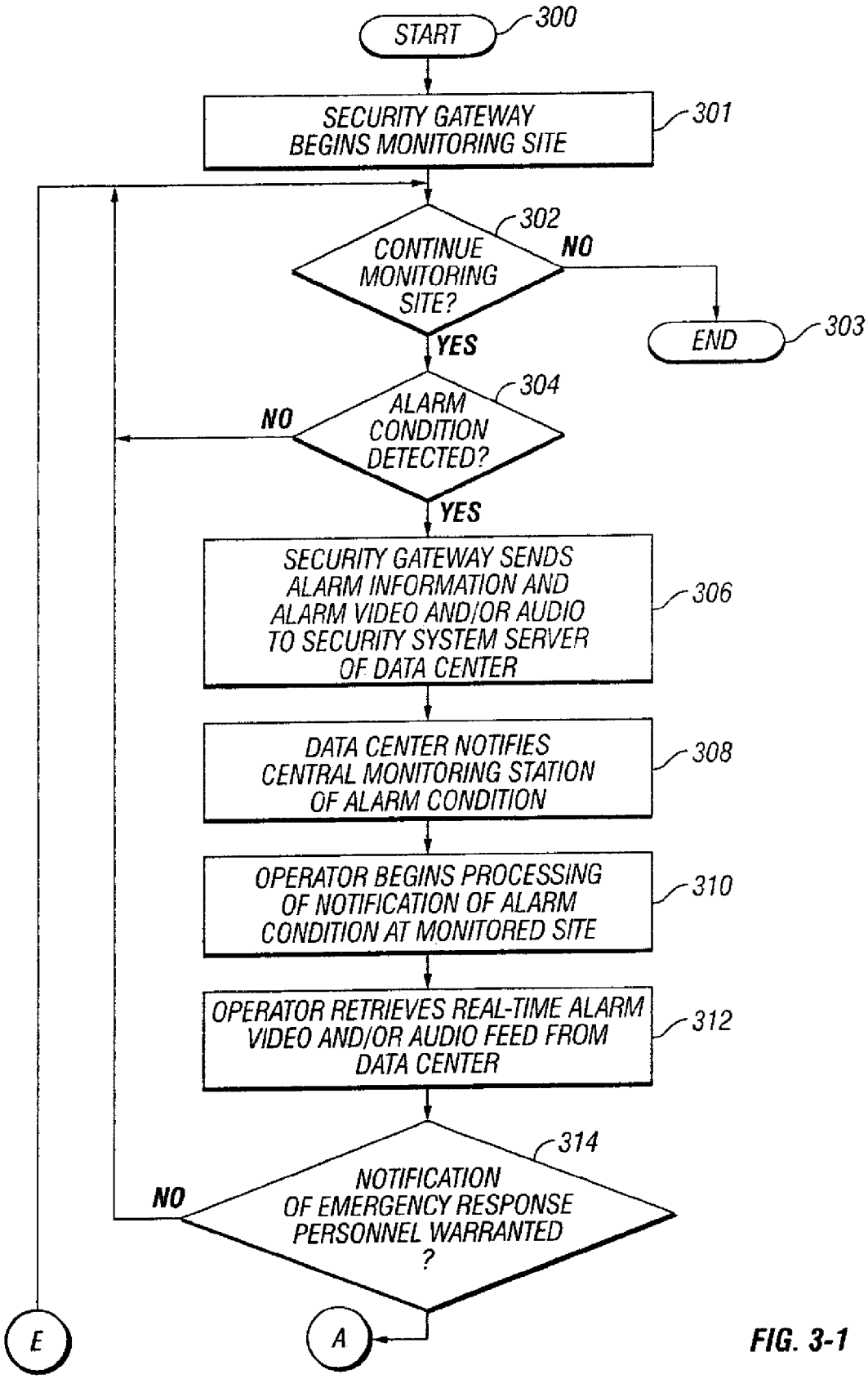
FIG. 3 is a flowchart of a method for providing a near real-time feed of alarm-related video and/or audio to a non-discriminatory security provider.
Figures 2, 3:
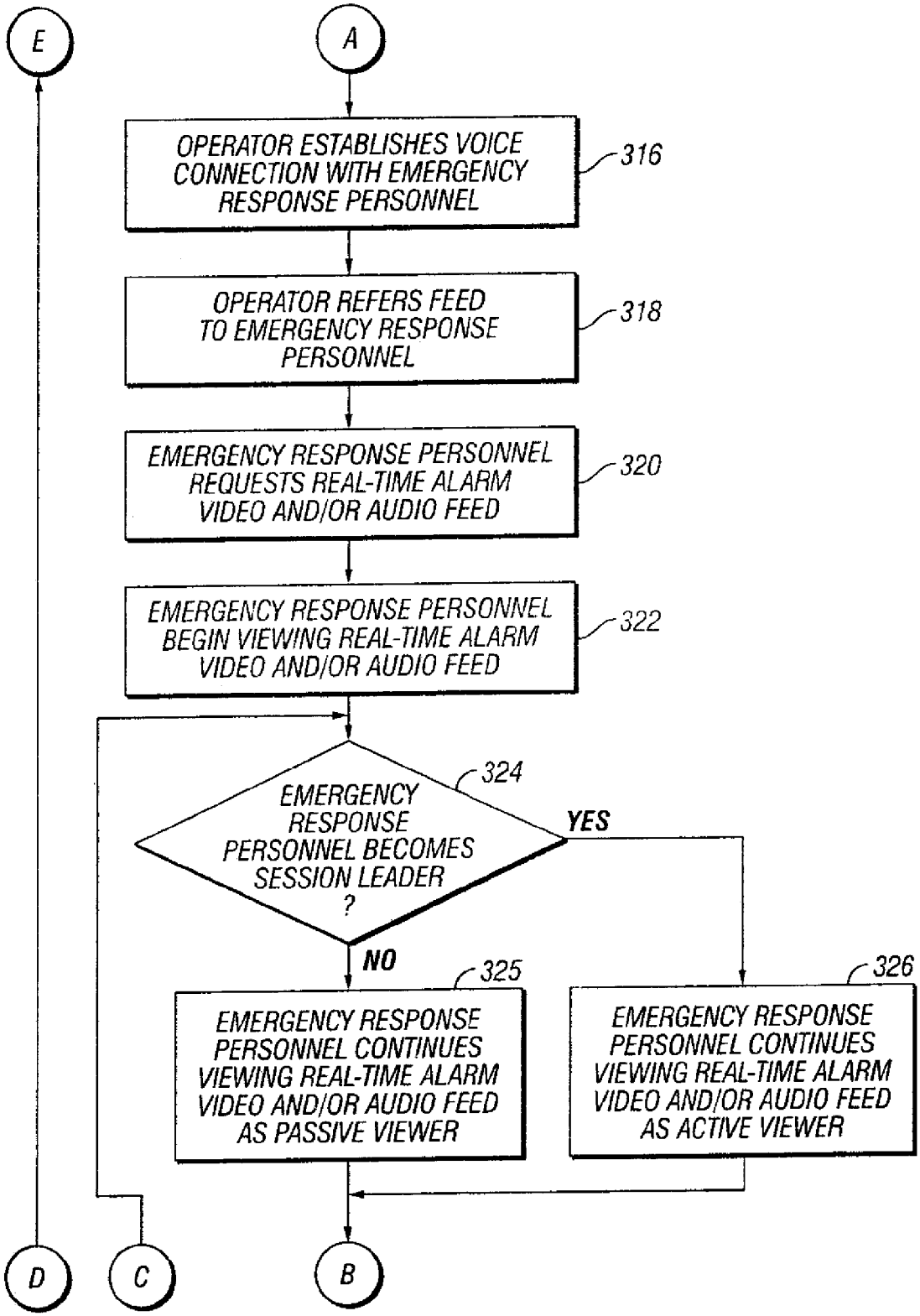
Figure 3:
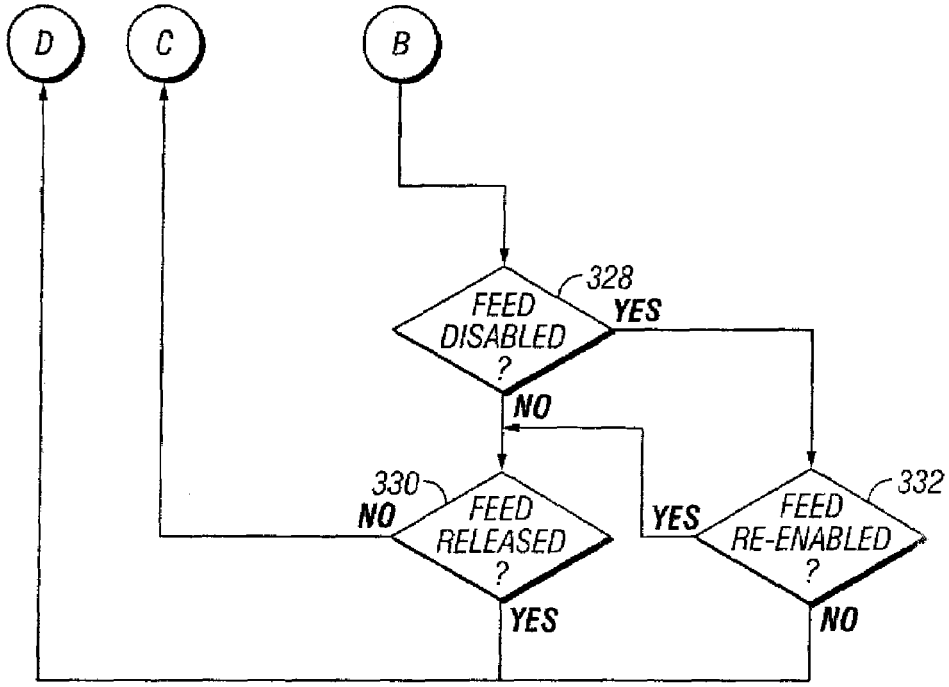

Referring next to FIG. 3, using an illustrative scenario, a method of providing a near real-time feed of alarm-related video and/or audio to a non-discriminatory security provider, for example, the public safety call center 140 or the emergency response vehicle 150, will now be described in greater detail. The method commences at step 300 and, at step 301, the monitoring devices are activated by the security gateway 115, typically, in response to the issuance of an "arm security system" command by the keypad 114 and the security gateway 115 begins monitoring the site 110. The method then proceeds to step 302 where the security gateway 115 will continue monitoring the site 110 until either deactivation, typically in response to the issuance of a "disarm security system" command by the keypad 114, and an end to the method at step 303 or detection of an alarm condition at step 304.

The detection of an alarm condition at step 304 may result from various occurrences such as triggering of one of the sensors 111, an analysis, by the security gateway 115, of video recorded by one of the video cameras 112, activation of a panic button, for example, a panic button located at the key pad 114, or any number of other scenarios involving data collected by the information collecting devices 111, 112 and 113. If an alarm condition corresponding to a possible alarm event is detected is detected at step 304, the method will proceed to step 306 where the security gateway 115 forwards alarm information to the security system server 182 via the data network 120. Typically, the alarm information is comprised of a notification of the alarm condition and information relating to the alarm condition, typically, a near real-time feed of video and/or audio originating at the monitored site 110. The near real-time feed of video and/or audio may commence at various points in time relative to the detection of an alarm condition. For example, upon one of the sensors 111 being triggered, the security gateway 115 will retrieve the cached video acquired by the video camera 112 and cached audio acquired by the audio station 113 associated with the triggered sensor 111 for transmission to the security system server 182. After transmitting the cached video and audio data, the security gateway 115 will begin streaming newly acquired video from the video camera 112 associated with the triggered sensor 111 and audio data from the audio station 113 to the security system server 182.

Continuing on to step 308, upon arrival at the security system server 182, the alarm information related to the alarm event is recorded by the monitoring automation database and the near real-time feed of video and/or audio is recorded by the media server 202. The monitoring automation database 204 then notifies the central monitoring station 130 of the alarm condition, for example, by transferring selected alarm information related to the alarm notification to the operator workstation 132. Upon receipt of a notification of the alarm condition, the method proceeds to step 310 where the operator of the operator workstation 132 will begin processing of the received notification of an alarm condition at the monitored site 110.

To process the received notification of an alarm condition, the operator must first determine whether the detected alarm condition warrants notification of public or private emergency response personnel. To evaluate the alarm condition, the operator may review the near real-time feed of alarm video and/or audio available at the data center 180. As the near real-time feed of alarm video and/or audio is oftentimes inconclusive, the operator may instead opt to evaluate video and/or audio data, archived at the data center 180, for the time period immediately preceding the occurrence of the alarm condition. To evaluate the near real-time feed of alarm video and/or audio, the archived pre-alarm video and/or audio, or both, the operator will launch an instance of the multi-media handler 208 at step 312. Using a suitable set of technologies, for example, the Active X set of technologies developed by Microsoft Corporation of Redmond, Wash., the multi-media handler 208 at the operator workstation 132 will retrieve the near real-time feed of alarm video and/or audio and/or the archived pre-alarm video and/or audio from the media server 202 at the data center 180 over the data network 120. The media server 202 will then render the retrieved near real-time feed of alarm video and/or archived pre-alarm video on a monitor (not shown) forming part of the operator workstation 132 while generating audio at a speaker (also not shown) also forming part of the operator workstation 132. Finally, the multi-media handler 208 executes an instance of the session leader 207 to enable the operator at the central monitoring station to exercise control over the near real-time feed of alarm video and/or audio being rendered, by the multi-media handler 208, at the operator workstation 132. Typically, as the operator workstation 132 will, at least initially, exercise control over the near real-time alarm video and/or audio feed, the multi-media handler 208 will execute an instance of the session leader 207 whenever a feed is retrieved from the media server 202 for the security system server 182. As will be more fully described below, this feature distinguishes the multi-media handler 208 which executes on the operator workstation 132 from the multi-media handler 214 which executes on the dispatcher workstation 142 and the multi-media handler 220 which executes on the field responder workstation 155. Although not explicitly shown in FIG. 3, if, at any time after step 312, the operator invokes the "full clear" function through the operator workstation 132, all video and/or audio feeds are terminated and the method will return to step 302 for further monitoring of the site 110 in the manner previously described.

Continuing on to step 314, the operator at the operator workstation 132 processes the received alarm information to determine if the detected alarm condition resulting in the transmission of the alarm information warrants notification of emergency response personnel. Processing of the received alarm information typically involves the operator following an evaluation protocol which may include, for example, a detailed examination of the received real-time alarm video and/or audio stream, assuming control of one or more of the video cameras 112 to conduct a video survey of the monitored site 110 and/or initiating an audio or audio/video exchange with the person or persons at the monitored site 110. If, in order to evaluate conditions at the monitored site 110, the operator must assume control of the video camera 112 generating the video feed, for example, to pivot the video camera 112 to another angle or switch the video feed to another video camera 112, the operator would issue, via the GUI of the operator workstation 132, the appropriate control commands to the session leader 207. In turn, the session leader 207 would pass the issued control commands to the feed manager 205 residing at the shared control server 184. Finally, the multi-media handler 208 would command the media server 202 to initiate the desired modification of the near real-time alarm video and/or audio feed being distributed.

If, at step 314, the operator determines that an alarm condition exists at the monitored site, the method proceeds to step 316 where the operator establishes a voice connection with selected emergency response personnel. Typically, the operator would contact a dispatcher at the public safety call center 140, typically via a telephone call over the PSTN 160. Alternately, of course, the operator at the operator workstation 132 may instead establish a voice connection with the dispatcher at the dispatcher workstation 142 over the data network 120. After establishing a voice connection with the dispatcher and advising the dispatcher or field responder of the relevant facts, for example, the location of the monitored site 110, the type of alarm triggered, any personal observations made while viewing the near real-time alarm video and/or audio feed, the operator will advise the dispatcher that the near real-time video and/or audio will then be made available for viewing at the dispatcher workstation 142. The feed manager 206 would provide the appropriate control commands to each multi-media handler, here, the multi-media handler 208, currently receiving the near real-time alarm video and/or audio feed from the media server 202 forming part of the security system server 182. At this time, the dispatcher or field responder and operator may also agree (or, in accordance with pre-established emergency protocols, may have previously agreed) whether the feed to be made available for viewing will be a passive feed in which control over the feed is maintained by the operator or an active feed in which control over the feed is ceded to the dispatcher.

The operator will then terminate the voice connection with the dispatcher. Of course, if necessary, the voice connection between the operator and the dispatcher may be maintained during all or part of the period in which the video and/or audio feed is being shared with the dispatcher.

While the video and/or audio feed being shared with the dispatcher may be either a passive or active feed, currently, passive feeds are generally preferred for a number of reasons, including the operator's greater familiarity with the type of security devices installed at the monitored site 110 and how to control those security devices from the remotely located workstation. Thus, it is contemplated that the operator will typically maintain full control of the video and/or audio feed and will, therefore, be able to select, from the operator workstation 132, the video camera 112 and/or the audio station 113 from which the video and/or audio feed is originating. Thus, while the dispatcher will be able to passively receive the video and/or audio feed at the dispatcher workstation 142, the dispatcher will only be able to issue requests, for example, using the voice connection previously established over the PSTN 160 or a new voice connection established over the PSTN 160, to the operator to modify the video and/or audio feed on the dispatcher's behalf. For example, the dispatcher may request that the operator select a different video camera 112 or audio station 113 from which the received video and/or audio stream is being received. Of course, if appropriate, the operator may decide to cede control of the video and/or audio feed to the dispatcher. In this embodiment, the dispatcher would be able to select a different video camera 112, select a different audio receiver 113 or otherwise modify the video and/or audio feed from the dispatcher workstation 142. Of course, it is fully contemplated that operator and/or dispatcher preferences for either active or passive video and/or audio feeds may vary for any number of reasons.

Continuing on to step 318, the operator at the operator workstation 132 will then refer the video and/or audio feed to the dispatcher at the dispatcher workstation 142 using the multi-media handler software module 208. To do so, the multi-media handler software module 208 will first notify the feed manager software module 205 of the desired sharing of the video and/or audio feed. If the proposed video and/or audio feed share is approved by the gatekeeper software module 206, the feed manager software module 205 will provide the multi-media handler software module 214 at the dispatcher workstation 142 with the information necessary to retrieve the near real-time video and/or audio feed from the media server 202. Continuing on to step 320, the dispatcher, through the multimedia handler 214, will then instruct the media server 202 to retrieve the video and/or audio feed. Using a suitable set of technologies, for example, the Active X set of technologies and the information received from the feed manager 205, the multi-media handler 214 at the dispatcher workstation 142 will retrieve the near real-time feed of alarm video and/or audio from the media server 202 at the data center 180 over the data network 120. The multi-media handler software module 214 will then render the retrieved near real-time feed of alarm video on a monitor (not shown) forming part of the dispatcher workstation 142 while generating audio at a speaker (also not shown) also forming part of the dispatcher workstation 142. The method will then proceed to step 322 where the dispatcher may begin viewing the near real-time video and/or audio feed originating at the monitored premises.

At some point in time after being contacted by the operator regarding the alarm condition at the premises, the dispatcher will contact the field respond, typically using the radio link between the public safety call center 140 and the emergency response vehicle 150. It is contemplated that, depending on the perceived urgency of the alarm condition, the dispatcher may decide to contact the field responder prior to, simultaneous with or shortly after obtaining the video and/or audio feed. The dispatcher will then relay information to the field responder regarding the alarm condition as it becomes available, for example, as the dispatcher continues to examine the video and/or audio feed received from the monitored premises 110. In this manner, it is contemplated that the field responder may be provided with more information regarding the alarm condition prior to arriving at the monitored site. For example, rather than merely notifying the field responder that an alarm sensor has been triggered at the monitored site 110, a subsequent examination of the video and/or audio feed from the monitored site 110 may reveal, for example, the location of the person or persons triggering the alarm and the activities in which they are currently engaged.

Continuing on to step 324, the dispatcher must decide whether to assume control of the video and/or audio feed. As previously set forth, absent a decision to assume control of the video and/or audio feed, the feed received by the dispatcher will be a passive feed and the method will proceed to step 325 where the dispatcher will continue to passively view the feed. If, however, the dispatcher assumes control of the video and/or audio feed, the method will instead proceed to step 326 where the dispatcher first takes control of the video and/or audio feed and begins actively viewing the feed. Typically, the decision as to whether the dispatcher is to assume active control of the feed is made during the initial conversation between the operator and the dispatcher. If it is decided during the initial voice conversation (or a subsequent voice conversation initiated by the dispatcher or operator, for example, if the dispatcher decides, after viewing the video and/or audio feed, that control of the feed should be assumed by the dispatcher), the operator must first use the session leader software module 207 to indicate, to the feed manager software module 205, of the desire to cede control of the video and/or audio feed to the dispatcher workstation 142.

In turn, the feed manager software module 205 indicates to the multi-media handler software module 214 that the dispatcher workstation 142 is to assume control of the video and/or audio feed. The multi-media handler software module 214 executes the instance of the session leader software module 212 residing at the dispatcher workstation. Upon successful execution thereof, the session leader software module 212 advises the feed manager software module 205 that it is ready to assume control of the video and/or audio feed. The feed manager software module 205 will then instruct the multi-media handler software module 208 that the session leader software module 212 is ready to assume control. In turn, the multi-media handler software module 208 will close the session leader software module 207. The dispatcher may now control the video and/or audio feed by using the GUI at the dispatcher workstation 212 to issue control commands to the session leader software module 212. In turn, the session leader software module 212 passes the control commands to the feed manager 205 which, in turn, advises each multimedia handler software module, here, the multi-media handler software modules 208 and 214 pulling the video and/or audio feed from the media server 202 of the changes in the video and/or audio feed to be pulled.

The method continues on to step 328 where the central monitoring station manager decides, from the manager workstation 134, whether to disable the feed being shared with the dispatcher workstation 142. If so, using a GUI residing on the manager workstation 134, the manager issues a command to the session disabler software module 209 instructing the gatekeeper software module 206 to disable, in the manner previously described with respect to FIG. 2, the video and/or audio feed being fed to the dispatcher workstation 142. If the video and/or audio feed is disabled at step 328, the method proceeds to step 332 where the manager will decide whether to re-enable the video and/or audio feed, again by issuing a command to the session disabler software module 209 to instruct the gatekeeper software module 206 to re-enable, in the manner previously described with respect to FIG. 2, the video and/or audio feed being fed to the dispatcher workstation 142.

If the manager decides not to re-enable the video and/or audio feed being shared with the dispatcher workstation 142, the method returns to step 302 for continued monitoring of the site 110 in the manner previously described. If, however, the manager re-enables the video and/or audio feed being shared with the dispatcher workstation 142 at step 332 or if, at step 328 the video and/or audio fed was never disabled, the method would instead proceed to step 330 where the dispatcher decides whether to release the shared video and/or audio feed. For example, if the field responder has arrived at the monitored site and resolved the emergency condition, the dispatcher would have no further need for the feed. Using the GUI at the dispatcher workstation 142, the dispatcher would instruct the multi-media handler 214 to: (1) terminate pulling the video and/or audio feed from the media server 202; and (2) advise the feed manager software module 205 that the dispatcher workstation would no longer be sharing the video and/or audio feed. In turn, the feed manager software module 205 would advise the multi-media handler software module 208 that the dispatcher workstation 142 has released the feed.

After completing, at step 332, the release of the video and/or audio feed in the foregoing manner, the method would return to step 302 for further monitoring of the site 110 in the manner previously described.

The foregoing method included a description of how the operator may share and/or cede control of the feed to the dispatcher. As the same method is used in the event that the operator and/or dispatcher decides to share and/or cede control of the feed to the field responder, the method by which the field responder may receive a passive or active video and/or audio feed need not be described in greater detail.

Thus, there has been described and illustrated herein, a security system configured to provide a near real-time passive or active video and/or audio feed related to an alarm condition to a public safety call center and/or field responder. However, those skilled in the art should recognize that numerous modifications and variations may be made in the techniques disclosed herein without departing substantially from the spirit and scope of the invention. Accordingly, the scope of the invention should only be defined by the claims appended hereto.

What is claimed is:

1. A security system for monitoring a premises, said security system comprising:

at least one device for collecting alarm information at said monitored premises;

a monitoring computer workstation remotely located relative to said monitored premises, said collected alarm information transported to said monitoring computer workstation over a data network in response to detection of an alarm condition at said monitored premises; and a first emergency response computer workstation remotely located relative to said monitored premises, said first emergency response computer workstation not collocated with said monitoring computer workstation;

said monitoring computer workstation configured to: (1) receive said collected alarm information over said data network: (2) actively control operation of said at least one alarm information collection device over said data network: (3) enable said first emergency response computer workstation to passively receive said collected alarm information and (4) cede active control of (a) operation of said at least one alarm information collection device and (b) delivery of said collected alarm information to said first emergency response computer workstation;

said first emergency response computer workstation configured to actively control (a) operation of said at least one alarm information collection device and (b) delivery of said collected alarm information upon said monitoring computer workstation ceding control of said at least one alarm information collection device to said first emergency response computer workstation.

2. The security system of claim 1, wherein said alarm information includes near real-time video.

3. The security system of claim 1, wherein said alarm information includes near real-time audio.

4. The security system of claim 1, wherein said alarm information includes near real-time video and near real-time audio.

5. The security system of claim 1, wherein said alarm information includes video and/or audio recorded prior to or during said alarm condition.

6. The security system of claim 1, and further comprising:

a computer server coupled to said data network, said computer server receiving said alarm information collected by said at least one alarm information collection device;

said monitoring computer workstation authorizing accesses, by said first emergency response computer workstation, to said alarm information received by said computer server.

7. The security system of claim 6, wherein said computer server is remotely located relative to said monitored premises.

8. The security system of claim 1, wherein said at least one alarm information collection device at said monitored premises includes at least two cameras and wherein said monitoring computer workstation is further configured to control switching between said at least two cameras for respective acquisition of near real-time video thereby whenever said monitoring computer workstation is in active control of operations of said at least two cameras and wherein said first emergency response computer workstation is configured to control switching between said at least two cameras for respective acquisition of near real-time video thereby whenever said monitoring computer workstation has ceded active control of said at least two cameras to said first emergency response computer workstation.

9. The security system of claim 1, wherein said at least one alarm information collection device at said monitored premises includes at least two audio stations and wherein said monitoring computer workstation is further configured to control switching between said at least two audio stations for respective acquisition of near real-time audio thereby whenever said monitoring computer workstation is in active control of operations of said at least two audio stations and wherein said first emergency response computer workstation is configured to control switching between said at least two audio stations for respective acquisition of near real-time audio thereby whenever said monitoring computer workstation has ceded active control of said at least two audio stations to said first emergency response computer workstation.

10. The security system of claim 1, wherein said at least one alarm information collection device includes an audio station and wherein said monitoring computer workstation is further configured to control adjusting microphone sensitivity of said audio station whenever said monitoring computer workstation is in active control of operations of said audio station and wherein said first emergency response computer workstation is configured to control adjusting microphone sensitivity of said audio station whenever said monitoring computer workstation has ceded active control of said audio station to said first emergency response computer workstation.

11. The security system of claim 1 wherein said at least one alarm information collection device includes an audio station and wherein said monitoring computer workstation is further configured to control speaker volume of said audio station whenever said monitoring computer workstation is in active control of operations of said audio station and wherein said first emergency response computer workstation is configured to control speaker volume of said audio station whenever said monitoring computer workstation has ceded active control of said audio station to said first emergency response computer workstation.

12. The security system of claim 1, wherein said at least one alarm information collection device includes an audio station and wherein said monitoring computer workstation is further configured to serve as an audio source for said audio station whenever said monitoring computer workstation is in active control of operations of said audio station and wherein said first emergency response computer workstation is configured to serve as said audio source for said audio station whenever said monitoring computer workstation has ceded active control of said audio station to said first emergency response computer workstation.

13. The security system of claim 1, wherein said at least one alarm information collection device includes an audio station and wherein said monitoring computer workstation is further configured to select between one-way operation of said audio station in which audio information may only be transported from said audio station to said monitoring computer workstation and two-way operation of said audio station in which audio information may be transported from said audio station to said monitoring computer workstation and from said monitoring computer workstation to said audio station whenever said monitoring computer workstation is in active control of operations of said audio station and wherein said first emergency response computer workstation is configured to select between one-way operation of said audio station in which audio information may only be transported from said audio station to said first emergency computer workstation and two-way operation of said audio station in which audio information may be transported from said audio station to said first emergency computer workstation and from said first emergency computer workstation to said audio station whenever said monitoring computer workstation has ceded active control of said audio station to said first emergency response computer workstation.

14. The security system of claim 1, wherein said alarm information includes video and audio information recorded prior to or during said alarm condition and wherein said monitoring computer workstation is configured to select between said recorded video information and said recorded audio information whenever said monitoring computer workstation is in active control of operations of said at least one alarm information collecting device and wherein said first emergency response computer workstation is configured to select between said recorded video information and said recorded audio information whenever said monitoring computer workstation has ceded active control of said audio station to said first emergency response computer workstation.

15. The security system of claim 1, wherein said at least one alarm information collection device includes a camera and wherein said monitoring computer workstation is further configured to adjust pan, tilt, zoom, focus, aperture and white balance functions of said camera whenever said monitoring computer workstation is in active control of operations of said camera and wherein said first emergency response computer workstation is configured to adjust pan, tilt, zoom, focus, aperture and white balance functions of said camera whenever said monitoring computer workstation has ceded active control of said audio station to said first emergency response computer workstation.

16. The security system of claim 1, wherein said first emergency response computer workstation is located within a public safety call center.

17. The security system of claim 1, wherein said first emergency response computer workstation is located within an emergency response vehicle.

18. The security system of claim 1, wherein said first emergency response computer workstation is located within a facility operated by private safety personnel.

19. The security system of claim 1, wherein said first emergency response computer workstation is further configured to return active control of the operation of said at least one alarm information collection device and control of the delivery of said collected alarm information to said monitoring computer workstation.

20. The security system of claim 19, wherein said monitoring computer workstation is unable to actively control operation of said least one alarm information collection device or delivery of said collected alarm information until after said first emergency response computer workstation returns active control thereto.

21. The security system of claim 1, and further comprising:

a second emergency response computer workstation remotely located relative to said monitored premises;

wherein said first emergency response computer workstation is further configured to cede active control of (a) operation of said at least one alarm information collection device and (b) delivery of said collected alarm information to said second emergency response computer workstation; and said second emergency response computer workstation configured to actively control (a) operation of said at least one alarm information collection device and (b) delivery of said collected alarm information.

22. The security system of claim 21, wherein said second emergency response computer workstation is not collocated with said first emergency response computer workstation.

23. The security system of claim 21, wherein said second emergency response computer workstation is further configured to return active control of the operation of said at least one alarm information collection device and control of delivery of said collected alarm information to said first emergency response computer workstation or said monitoring computer workstation.

24. The security system of claim 23, wherein said means for collecting alarm information at said monitored premises further comprises:

a base station coupled to said data network, said base station located at said monitored premises; and a plurality of video cameras coupled to said base station;

wherein said alarm information is comprised of a near real-time stream of video data from a first one of said plurality of video cameras.

25. The security system of claim 24, and further comprising:

means for controlling said plurality of video cameras from said monitoring computer workstation; and means for ceding control of said plurality of video cameras from said monitoring computer workstation to said emergency response computer workstation.

26. The security system of claim 25, and further comprising:

a plurality of audio recording devices coupled to said base station;

wherein said alarm information further comprises a near real-time stream of audio data from a first one of said plurality of audio recording devices.

27. The security system of claim 26, and further comprising:

means for controlling said plurality of audio recording devices from said monitoring computer workstation; and means for ceding control of said plurality of audio recording devices from said monitoring computer workstation to said emergency response computer workstation.

28. The security system of claim 23, and further comprising:

a manager workstation, said manager station configured to suspend the (a) authorization of the transport of said collected alarm information and (b) ceding of active control of said at least one alarm information collection device to said second emergency response computer workstation.

29. The security system of claim 28, wherein said manager workstation is further configured to cancel the (a) said suspension of authorization of the transport of said collected alarm information and (b) ceding of active control of said at least one alarm information collection device to said second emergency response computer workstation.

30. The security system of claim 1, and further comprising:

a manager workstation, said manager station configured to suspend the ceding of active control of (a) operation of said at least one alarm information collection device and (b) delivery of said collected alarm information to said first emergency response computer workstation.

31. The security system of claim 30, wherein said manager workstation is collocated with said monitoring computer workstation.

32. The security system of claim 30, wherein said manager workstation is collocated with said first emergency response computer workstation.

33. The security system of claim 30, wherein said manager workstation is further configured to cancel said suspension of the ceding of active control of (a) operation of said at least one alarm information collection device and (b) delivery of said collected alarm information to said first emergency response computer workstation.

34. The security system of claim 1, wherein said security system further comprises:

an application administration workstation, said application administration workstation configured to control eligibility of said first emergency response computer workstation to actively control (a) operation of said at least one alarm information collection device and (a) delivery of said collected alarm information.

35. The security system of claim 34, wherein said application administration workstation is configured to manage eligibility on a non-discriminatory basis.

36. The security system of claim 34, wherein said application administration workstation is configured to manage eligibility on a discriminatory basis.

37. A security system for monitoring a premises, said security system comprising:

at least one device for collecting alarm information at said monitored premises;

a first computer server, said computer server receiving said alarm information from said at least one device over a first secured data path;

a first computer workstation remotely located relative to said monitored premises, said first computer workstation receiving said alarm information, from said first computer server, over a second secured data path; and a second computer workstation remotely located relative to said monitored premises; and a second computer server, said second computer server receiving, over a fourth secured data path, requests, from said first computer workstation, for authorization of said second computer workstation to receive said alarm information from said first computer server;

said first computer workstation configured to control said at least one alarm information collection device using control commands transmitted to said first computer server over said second secured data path and passed, by said first computer server, to said at least one alarm information collection device over said first secured data path;

said first computer workstation further configured to authorize said second computer workstation to receive said alarm information from said first computer server;

said first computer workstation still further configured to cede active control of the operation of said at least one alarm information collection device to said second computer workstation;

said second computer workstation configured to receive said alarm information, from said first computer server, over a third secured data path upon authorization, by said first computer workstation, to receive said alarm information from said first computer server;

said second computer workstation further configured to receive, over a fifth secured data path, information, from said second computer server, enabling said second computer workstation to access said alarm information received by said first computer server;

said second computer workstation still further configured to control said at least one alarm information collection device using control commands transmitted to said first computer server over said third secured data path and passed, by said first computer server, to said alarm information collection device over said first secured data path upon receipt of a message, from said first computer workstation that said first computer workstation has ceded control to said second computer workstation and said second computer workstation has received, over said fifth secured data path, information, from said first computer server, enabling said second computer workstation to assume control of said at least one alarm information collection device for which control has been ceded to said second computer workstation.

38. The security system of claim 37, wherein said collected alarm information includes a near real-time stream of video and/or audio data.

39. The security system of claim 38, wherein:

said first computer server is remotely located relative to said monitored premises;

said first computer workstation is remotely located relative to said first computer server;

said second computer workstation is remotely located relative to said first computer server and said first computer workstation.

40. The security system of claim 39, wherein said first computer server is collocated with said second computer server.

41. The security system of claim 40, and further comprising:

a third computer workstation, said second computer server receiving, over a sixth secured data path, requests, from said third computer workstation, to disable the authorization of said second computer workstation to receive said alarm information from said first computer server; and said second computer workstation receiving, over said fifth secured data path, information, from said second computer server, disabling said second computer workstation's ability to access said alarm information received by said first computer server.

42. The security system of claim 41, wherein said third computer workstation is collocated with said first computer workstation.

43. The security system of claim 41, wherein said third computer workstation is collocated with said second computer workstation.

44. A security system for monitoring a premises, said security system comprising:

at least one device for collecting alarm information at said monitored premises;

a first computer server coupled to said at least one device over a data network, said computer server receiving said alarm information from said at least one device over said data network;

a monitoring computer workstation coupled to said first computer server, said monitoring computer remotely located relative to said monitored premises, said monitoring computer workstation configured to (a) receive said alarm information from said first computer server, (1) selectively authorize workstations to receive said alarm information from said first computer server, (c) control the collection of alarm information by said at least one alarm information collection device and (d) selectively cede active control of said at least one alarm information collection device to workstations; and an emergency response computer workstation remotely located relative to said monitored premises, said emergency response computer workstation configured to (a) receive said alarm information from said first computer server, upon authorization, by said monitoring computer workstation, to receive said alarm information and (b) actively control said at least one alarm information collection device upon said monitoring computer workstation ceding control of said at least one alarm information collection device to said emergency response computer workstation.

45. The security system of claim 44, wherein said alarm information includes recorded video and recorded audio.

46. The security system of claim 44, wherein said alarm information includes near real-time video and near real-time audio.

47. The security system of claim 46, wherein:

said at least one device for collecting alarm information includes an audio station;

said monitoring computer workstation further configured to transport audio information originating thereat to said first computer server;

said emergency response computer workstation further configured to transport audio information originating thereat to said first computer server when authorized, by said monitoring computer workstation, to transport said audio information; and said first computer server further configured to transport audio information originating at either said monitoring computer workstation or said emergency response computer workstation to said audio station.

48. The security system of claim 44, wherein said first computer server is remotely located relative to said monitored premises.

49. The security system of claim 48 wherein a secured data path couples said first computer server with said at least one alarm information collecting device.

50. The security system of claim 44, wherein said monitoring computer workstation is remotely located relative to said first computer server.

51. The security system of claim 50, wherein a secured data path couples said first computer server with said monitoring computer workstation.

52. The security system of claim 44, wherein said emergency response computer workstation is remotely located relative to said first computer server.

53. The security system of claim 52, wherein a secured data path couples said first computer server with said emergency response computer workstation.

54. The security system of claim 52, wherein said emergency response computer workstation is located in a public safety call center.

55. The security system of claim 52, wherein said emergency response computer workstation is located in an emergency response vehicle.

56. The security system of claim 52, wherein said emergency response computer workstation is located on the person of a field responder.

57. The security system of claim 44, wherein said monitoring computer workstation controls the collection of alarm information by said at least one alarm information collection device using control commands transmitted thereby to said first computer server and relayed, by said first computer server, to said at least one alarm information collection device.

58. The security system of claim 57, wherein said at least one device for collecting alarm information at said monitored premises includes at least two cameras and wherein said monitoring computer workstation is further configured to control switching between said at least two cameras for respective acquisition of near real-time video thereby whenever said monitoring computer workstation is in active control of operations of said at least two cameras and wherein said emergency response computer workstation is configured to control switching between said at least two cameras for respective acquisition of near real-time video thereby whenever said monitoring computer workstation has ceded active control of said at least two cameras to said emergency response computer workstation.

59. The security system of claim 57, wherein said at least one device for collecting alarm information at said monitored premises includes at least two audio stations and wherein said monitoring computer workstation is further configured to control switching between said at least two audio stations for respective acquisition of near real-time audio thereby whenever said monitoring computer workstation is in active control of operations of said at least two audio stations and wherein said emergency response computer workstation is configured to control switching between said at least two audio stations for respective acquisition of near real-time audio thereby whenever said monitoring computer workstation has ceded active control of said at least two audio stations to said emergency response computer workstation.

60. The security system of claim 57, wherein said at least one device for collecting alarm information includes an audio station and wherein said monitoring computer workstation is further configured to control adjusting microphone sensitivity of said audio station whenever said monitoring computer workstation is in active control of operations of said audio station and wherein said emergency response computer workstation is configured to control adjusting microphone sensitivity of said audio station whenever said monitoring computer workstation has ceded active control of said audio station to said emergency response computer workstation.

61. The security system of claim 57, wherein said at least one device for collecting alarm information includes an audio station and wherein said monitoring computer workstation is further configured to control speaker volume of said audio station whenever said monitoring computer workstation is in active control of operations of said audio station and wherein said emergency response computer workstation is configured to control speaker volume of said audio station whenever said monitoring computer workstation has ceded active control of said audio station to said emergency response computer workstation.

62. The security system of claim 57, wherein said at least one device for collecting alarm information includes an audio station and wherein said monitoring computer workstation is further configured to select between one-way operation of said audio station in which audio information may only be transported from said audio station to said first computer server and subsequently relayed, by said first computer server, to said monitoring computer workstation and two-way operation of said audio station in which audio information may be transported from said audio station to said first computer server and subsequently relayed, by said first computer server, to said monitoring computer workstation and from said monitoring computer workstation to said first computer server and subsequently relayed, by said first computer server, to said audio station whenever said monitoring computer workstation is in active control of operations of said audio station and wherein said emergency response computer workstation is configured to select between one-way operation of said audio station in which audio information may only be transported from said audio station to said emergency computer workstation and two-way operation of said audio station in which audio information may be transported from said audio station to said emergency computer workstation and from said first emergency computer workstation to said audio station whenever said monitoring computer workstation has ceded active control of said audio station to said emergency response computer workstation.

63. The security system of claim 57, wherein said at least one device for collecting alarm information includes a camera and wherein said monitoring computer workstation is further configured to control said camera to adjust pan, tilt, zoom, focus, aperture and white balance functions thereof whenever said monitoring computer workstation is in active control of operations of said camera and wherein said emergency response computer workstation is configured to control said camera to adjust, pan, tilt, zoom, focus, aperture and white balance functions thereof whenever said monitoring computer workstation has ceded active control of said camera to said emergency response computer workstation.

64. The security system of claim 44, and further comprising:

a second computer server coupled to said data network, said second computer server receiving, from said monitoring computer workstation, requests for authorization of said emergency response computer workstation to receive said alarm information from said computer server;

wherein the collection of alarm information by said at least one alarm information collection device may be controlled by said emergency response computer workstation using control commands transmitted to said first computer server and passed, by said first computer server, to said at least one alarm information collection device over said data network if said second computer server receives a message, from said monitoring computer workstation, indicating that said monitoring computer workstation has ceded control of the collection of alarm information by said at least one alarm information collection device to said emergency response computer workstation and said emergency response computer workstation has received information, from said second computer server, enabling said emergency response computer workstation to assume the control of said at least one alarm information collection device ceded, to said emergency response computer workstation, by said monitoring computer workstation.

65. The security system of claim 64, wherein said second computer server is configured to verify eligibility of said emergency response computer workstation to control operation of said at least one alarm information collection device.

66. The security system of claim 65, wherein said second computer server is configured to verify eligibility of said emergency response computer workstation by checking said emergency response computer workstation against a permissions database maintained by said second computer server.

67. The security system of claim 64, wherein:

said monitoring computer workstation is further configured to transmit information, to said second computer server, identifying alarm information that should be requested by said emergency response computer workstation;

said second computer server is further configured to relay said information, received from said monitoring computer workstation, to said emergency response computer workstation; and said emergency response computer workstation is further configured to issue requests, to said first computer server, for alarm information identified in said information received from said second computer server.

68. The security system of claim 67, wherein said at least one device for collecting alarm information at said monitored premises includes at least one camera and wherein said alarm information includes near real-time video acquired by said at least one camera.

69. The security system of claim 67, wherein said at least one device for collecting alarm information at said monitored premises includes at least one audio station and wherein said alarm information includes near real-time audio acquired by said at least one audio station.

70. The security system of claim 67, wherein said at least one device for collecting alarm information at said monitored premises includes at least one camera and wherein said alarm information includes recorded video acquired by said at least one camera.

71. The security system of claim 67, wherein said at least one device for collecting alarm information at said monitored premises includes at least one audio station and wherein said alarm information includes recorded audio acquired by said at least one audio station.

72. The security system of claim 67, wherein a secured data path couples said second computer server to said monitoring computer workstation.

73. The security system of claim 67, wherein a secured data path couples said second computer server to said emergency response computer workstation.

74. The security system of claim 67, and further comprising:

a manager workstation, said manager station configured to issue instructions to said second computer server to suspend authorization of the transport of said collected alarm information from said first computer server to said first emergency response computer workstation;

said second computer server further configured to relay instructions, to said emergency response computer workstation, suspending receipt, by said emergency response computer workstation, of said alarm information from said first computer server.

75. The security system of claim 74, wherein a secured data path couples said second computer server and said manager workstation.

76. The security system of claim 74, wherein a secured data path couples said second computer server and said emergency response computer workstation.

77. The security system of claim 74, wherein:

said manager workstation is further configured to issue instructions canceling said suspension of receipt, by said emergency response computer workstation, of said alarm information from said first computer server;

said second computer server further configured to relay instructions, to said emergency response computer workstation, to resume receipt, by said emergency response computer workstation, of said alarm information from said first computer server.

78. The security system of claim 74, wherein said manager workstation is collocated with said monitoring computer workstation.

79. The security system of claim 74, wherein said manager workstation is collocated with said emergency response computer workstation.

80. The security system of claim 67, wherein said security system further comprises an application administration workstation, said application administration workstation configured to provide said second computer server with said permissions data governing eligibility of said emergency response computer workstation to be authorized to receive said alarm information.

81. The security system of claim 80, wherein a secured data path couples said second computer server to said application administration workstation.

82. The security system of claim 80, wherein said permissions data is stored on said second computer server.

83. The security system of claim 80, wherein said permissions data is stored on said first computer server.

84. The security system of claim 80, wherein said permissions data provided to said second computer server grants access to said alarm information on a non-discriminatory basis.

85. The security system of claim 84, wherein said non-discriminatory basis is based upon a determination of whether said monitored premises is located within a geographical area serviced by a public safety provider operating said emergency response computer workstation.

86. The security system of claim 80, wherein said permissions data provided to said second computer server by said application administration workstation grants access to said alarm information on a discriminatory basis.

87. The security system of claim 86, wherein said discriminatory basis is based upon participation of an owner or occupant of said monitored premises with a security service operating said monitoring computer workstation.

88. A security system for monitoring a premises, said security system comprising:

means for collecting alarm information at said monitored premises;

a first computer workstation remotely located relative to said monitored premises, said first computer workstation configured to (1) retrieve said collected alarm information over a data network and (2) actively control operation of said alarm information collection means;

a second computer workstation coupled to said data network, said second computer workstation remotely located relative to said monitored premises and to said first computer workstation;

means for authorizing said second computer workstation to retrieve said collected alarm information over said data network; and means for ceding control of said alarm information collection means to said second computer workstation.

89. The security system of claim 88, wherein said first computer workstation is a monitoring computer workstation.

90. The security system of claim 89, wherein said second computer workstation is an emergency response computer workstation.

91. A security system for monitoring a premises, said security system comprising:

at least one device for collecting alarm information at said monitored premises;

a computer server coupled to said at least one alarm information collection device over a data network, said computer server receiving said alarm information from said at least one alarm information collection device over said data network;

a monitoring computer workstation remotely located relative to said monitored premises, said computer server delivering said alarm information to said monitoring computer workstation; and an emergency response computer workstation remotely located relative to said monitored premises, said emergency response computer workstation configured to receive said alarm information from said computer server when authorized, by said monitoring computer workstation, to receive said alarm information;

said computer server receiving, from said monitoring computer workstation, requests for authorization of said emergency response computer workstation to receive said alarm information from said computer server;

said monitoring computer workstation configured to actively control operation of said at least one alarm information collection device and further configured to cede active control of the operation of said at least one alarm information collection device and delivery of said collected alarm information to said emergency response computer workstation;

said emergency response computer workstation configured to actively control the operation of said at least one alarm information collection device upon said monitoring computer workstation ceding control of said at least one alarm information collection device to said emergency response computer workstation.

92. The security system of claim 91, wherein said alarm information includes recorded video and recorded audio.

93. The security system of claim 92, wherein:

said at least one device for collecting alarm information includes an audio station;

said monitoring computer workstation further configured to transport audio information originating thereat to said computer server;

said emergency response computer workstation further configured to transport audio information originating thereat to said computer server when authorized, by said monitoring computer workstation, to transport said audio information; and said computer server further configured to transport audio information originating at either said monitoring computer workstation or said emergency response computer workstation to said audio station.

94. The security system of claim 91, wherein said alarm information includes near real-time video and near real-time audio.

95. The security system of claim 91, wherein said computer server is remotely located relative to said monitored premises.

96. The security system of claim 95, wherein a secured data path couples said computer server with said at least one alarm information collecting device.

97. The security system of claim 91, wherein said monitoring computer workstation is remotely located relative to said computer server.

98. The security system of claim 97, wherein a secured data path couples said computer server with said monitoring computer workstation.

99. The security system of claim 91, wherein said emergency response computer workstation is remotely located relative to said computer server.

100. The security system of claim 99, wherein a secured data path couples said computer server with said emergency response computer workstation.

101. The security system of claim 99, wherein said emergency response computer workstation is located in a public safety call center.

102. The security system of claim 101, wherein said monitoring computer workstation is further configured to control the collection of alarm information by said at least one device using control commands transmitted thereby to said computer server and relayed, by said computer server, to said at least one device.

103. The security system of claim 102, wherein said at least one device for collecting alarm information at said monitored premises includes at least one camera and wherein said alarm information includes near real-time video acquired by said at least one camera.

104. The security system of claim 102, wherein said at least one device for collecting alarm information at said monitored premises includes at least one audio station and wherein said alarm information includes near real-time acquired by said at least one audio station.

105. The security system of claim 102, wherein said at least one device for collecting alarm information at said monitored premises includes at least one camera and wherein said alarm information includes recorded video acquired by said at least one camera.

106. The security system of claim 102, wherein said at least one device for collecting alarm information at said monitored premises includes at least one audio station and wherein said alarm information includes recorded audio acquired by said at least one audio station.

107. The security system of claim 102, wherein said at least one device for collecting alarm information at said monitored premises includes at least two cameras and wherein said monitoring computer workstation is further configured to control switching between said at least two cameras for respective acquisition of near real-time video thereby whenever said monitoring computer workstation is in active control of operations of said at least two cameras and wherein said emergency response computer workstation is configured to control switching between said at least two cameras for respective acquisition of near real-time video thereby whenever said monitoring computer workstation has ceded active control of said at least two cameras to said emergency response computer workstation.

108. The security system of claim 102, wherein said at least one device for collecting alarm information at said monitored premises includes at least two audio stations and wherein said monitoring computer workstation is further configured to control switching between said at least two audio stations for respective acquisition of near real-time audio thereby whenever said monitoring computer workstation is in active control of operations of said at least two audio stations and wherein said emergency response computer workstation is configured to control switching between said at least two audio stations for respective acquisition of near real-time audio thereby whenever said monitoring computer workstation has ceded active control of said at least two audio stations to said emergency response computer workstation.

109. The security system of claim 102, wherein said at least one device for collecting alarm information includes an audio station and wherein said monitoring computer workstation is further configured to control adjusting microphone sensitivity of said audio station whenever said monitoring computer workstation is in active control of operations of said audio station and wherein said emergency response computer workstation is configured to control adjusting microphone sensitivity of said audio station whenever said monitoring computer workstation has ceded active control of said audio station to said emergency response computer workstation.

110. The security system of claim 102, wherein said at least one device for collecting alarm information includes an audio station and wherein said monitoring computer workstation is further configured to control speaker volume of said audio station whenever said monitoring computer workstation is in active control of operations of said audio station and wherein said emergency response computer workstation is configured to control speaker volume of said audio station whenever said monitoring computer workstation has ceded active control of said audio station to said emergency response computer workstation.

111. The security system of claim 102, wherein said at least one device for collecting alarm information includes an audio station and wherein said monitoring computer workstation is further configured to select between one-way operation of said audio station in which audio information may only be transported from said audio station to said computer server and subsequently relayed, by said computer server, to said monitoring computer workstation and two-way operation of said audio station in which audio information may be transported from said audio station to said computer server and subsequently relayed, by said computer server, to said monitoring computer workstation and from said monitoring computer workstation to said computer server and subsequently relayed, by said computer server, to said audio station whenever said monitoring computer workstation is in active control of operations of said audio station and wherein said emergency response computer workstation is configured to select between one-way operation of said audio station in which audio information may only be transported from said audio station to said computer server and subsequently relayed, by said computer server, to said emergency response computer workstation and two-way operation of said audio station in which audio information may be transported from said audio station to said computer server and subsequently relayed, by said computer server, to said emergency response computer workstation and from said emergency response computer workstation to said computer server and subsequently relayed, by said computer server, to said audio station whenever said monitoring computer workstation has ceded active control of said audio station to said emergency response computer workstation.

112. The security system of claim 102, wherein said at least one device for collecting alarm information includes a camera and wherein said monitoring computer workstation is further configured to control said camera to adjust pan, tilt, zoom, focus, aperture and white balance functions thereof whenever said monitoring computer workstation is in active control of operations of said camera and wherein said emergency response computer workstation is configured to control said camera to adjust pan, tilt, zoom, focus, aperture and white balance whenever said monitoring computer workstation has ceded active control of said camera to said emergency response computer workstation.

113. The security system of claim 99, wherein said emergency response computer workstation is located in an emergency response vehicle.

114. The security system of claim 99, wherein said emergency response computer workstation is located on the person of a field responder.

115. The security system of claim 114, wherein the collection of alarm information by said at least one alarm information collection device is controlled by said emergency response computer workstation using control commands transmitted to said computer server and relayed, by said computer server, to said at least one alarm information collection device if said computer server receives a message, from said monitoring computer workstation, indicating that said monitoring computer workstation has ceded control of said at least one alarm information collection device to said emergency response computer workstation and said emergency response computer workstation has received information, from said computer server, enabling said emergency response computer workstation to assume the control of said at least one alarm information collection device for which control was ceded to said emergency response computer workstation by said monitoring computer workstation.

116. The security system of claim 91, wherein said computer server is configured to verify eligibility of said emergency response computer workstation to receive said alarm information.

117. The security system of claim 116, wherein said computer server is configured to verify eligibility of said emergency response computer workstation by checking said emergency response computer workstation against a permissions database maintained thereby.

118. The security system of claim 117, wherein said permissions data provided to said second computer server grants access to said alarm information on a non-discriminatory basis.

119. The security system of claim 116, wherein said non-discriminatory basis is based upon a determination of whether said monitored premises is located within a geographical area serviced by a public safety provider operating said emergency response computer workstation.

120. The security system of claim 117, wherein said permissions data provided to said second computer server by said application administration workstation grants access to said alarm information on a discriminatory basis.

121. The security system of claim 120, wherein said discriminatory basis is based upon participation of an owner or occupant of said monitored premises with a security service operating said monitoring computer workstation.

122. The security system of claim 91, wherein:

said monitoring computer workstation is further configured to transmit information, to said computer server, identifying alarm information that should be requested by said emergency response computer workstation;

said computer server is further configured to relay said information, received from said monitoring computer workstation, to said emergency response computer workstation; and said emergency response computer workstation is further configured to issue requests, to said computer server, for alarm information identified in said information received from said computer server.

123. The security system of claim 120, and further comprising:

a manager computer workstation, said manager station configured to issue instructions to said computer server to suspend authorization of the transport of said collected alarm information from said computer server to said emergency response computer workstation;

said computer server further configured to relay instructions, to said emergency response computer workstation, suspending receipt, by said emergency response computer workstation, of said alarm information from said computer server.

124. The security system of claim 123, wherein a secured data path couples said computer server and said manager workstation.

125. The security system of claim 123, wherein:

said manager computer workstation is further configured to issue instructions canceling said suspension of receipt, by said emergency response computer workstation, of said alarm information from said computer server;

said computer server further configured to relay instructions, to said emergency response computer workstation, to resume receipt, by said emergency response computer workstation, of said alarm information from said computer server.

126. The security system of claim 123, wherein said manager workstation is collocated with said monitoring computer workstation.

127. The security system of claim 126, wherein a secured data path couples said computer server to said application administration workstation.

128. The security system of claim 123, wherein said manager workstation is collocated with said emergency response computer workstation.

129. The security system of claim 123, wherein said security system further comprises an application administration workstation, said application administration workstation configured to provide said computer server with said permissions data governing eligibility of said emergency response computer workstation to be authorized to receive said alarm information.

* * * * *